US009821279B2

(12) United States Patent
Pasquier et al.

(10) Patent No.: US 9,821,279 B2
(45) Date of Patent: Nov. 21, 2017

(54) DEVICE FOR DIFFUSING AN ENCAPSULATED MATERIAL IN A WATER STREAM

(71) Applicant: SKINJAY, Paris (FR)

(72) Inventors: Nicolas Pasquier, Chantilly (FR); Loic Dubos, Toulouse (FR)

(73) Assignee: SKINJAY, Paris (FR)

( * ) Notice: Subject to any disclaimer, the term of this patent is extended or adjusted under 35 U.S.C. 154(b) by 113 days.

(21) Appl. No.: 14/786,463

(22) PCT Filed: Apr. 18, 2014

(86) PCT No.: PCT/FR2014/050951
§ 371 (c)(1),
(2) Date: Oct. 22, 2015

(87) PCT Pub. No.: WO2014/174191
PCT Pub. Date: Oct. 30, 2014

(65) Prior Publication Data

US 2016/0129404 A1 May 12, 2016

(30) Foreign Application Priority Data

Apr. 26, 2013 (FR) ..... 13 53866
Aug. 20, 2013 (FR) ..... 13 58094

(51) Int. Cl.
*A62C 5/02* (2006.01)
*B01F 1/00* (2006.01)
(Continued)

(52) U.S. Cl.
CPC ..... *B01F 1/0027* (2013.01); *B01F 3/0865* (2013.01); *B01F 5/0496* (2013.01); *E03C 1/046* (2013.01)

(58) Field of Classification Search
CPC .... B01F 1/0027; B01F 5/0496; B01F 3/0865; E03C 1/046
(Continued)

(56) References Cited

U.S. PATENT DOCUMENTS 2,120,807 A * 6/1938 Kundel ..... A47L 15/4436 137/268
3,349,788 A 10/1967 Chester
(Continued)

FOREIGN PATENT DOCUMENTS

DE 29801844 U1 5/1998
WO 2011107221 A1 9/2011

*Primary Examiner* — Arthur O Hall
*Assistant Examiner* — Joel Zhou
(74) *Attorney, Agent, or Firm* — Notaro, Michalos & Zaccaria P.C.

(57) ABSTRACT

Diffusion device intended to accept a flanged capsule containing a product that is to be diffused comprising a body, a bearing surface borne by the body directly or indirectly, an outlet passage for letting product out of the capsule, a knob mounted with the ability to rotate on the body, the knob comprising an upper part projecting axially beyond the bearing surface, the knob and the bearing surface being mounted with the capacity for helicoidal rotation relative to one another, a closure movement of the knob being able to bring the lower face of a rim of the device to face the bearing surface, the closure movement of the knob comprising a rotational movement of the knob with respect to the body causing a helicoidal movement between the knob and the bearing surface that is able to bring a lower face of the rim and the bearing surface closer together.

25 Claims, 13 Drawing Sheets

(51) Int. Cl.
*E03C 1/046* (2006.01)
*B01F 5/04* (2006.01)
*B01F 3/08* (2006.01)

(58) Field of Classification Search
USPC .... 239/310, 317, 318; 4/597, 596, 605, 615, 4/662; 210/335, 198.1, 200, 201, 202, 210/205, 167.11
See application file for complete search history.

(56) References Cited

U.S. PATENT DOCUMENTS

| | | | | | |
|---|---|---|---|---|---|
| 4,294,280 | A * | 10/1981 | Tom | E03C 1/046 | 137/268 |
| 4,642,100 | A | 2/1987 | Kabbaby | | |
| 4,873,727 | A * | 10/1989 | Homan | B01F 5/0496 | 4/226.1 |
| 4,933,080 | A | 6/1990 | Rundzaitis et al. | | |
| 6,036,110 | A * | 3/2000 | Kanatzar | E03C 1/046 | 239/317 |
| 6,241,884 | B1 * | 6/2001 | Hansen | B29C 39/02 | 137/268 |
| 6,397,879 | B1 * | 6/2002 | Ring | A61L 2/16 | 137/268 |
| 7,661,607 | B1 * | 2/2010 | Bowden | B05B 7/2456 | 137/268 |
| 2005/0039793 | A1 * | 2/2005 | Zhadanov | B01F 5/0496 | 137/268 |
| 2008/0302885 | A1 * | 12/2008 | O'Brien | B05B 7/2443 | 239/310 |
| 2013/0098820 | A1 * | 4/2013 | King | B01F 5/0496 | 210/202 |

* cited by examiner

-29A-

-29B-

DEVICE FOR DIFFUSING AN ENCAPSULATED MATERIAL IN A WATER STREAM

The invention relates to the field of diffusing an encapsulated product into a stream of water and more particularly into washing water such as bath water, shower water or the like.

WO 2011107221 discloses a device for diffusing a product of the shower gel, shampoo, essential oil or other type, packaged in the form of disposable capsules which are punctured as the casing intended to accept the capsule is closed. This casing comprises a hatch or a stopper that can be unscrewed in order to allow it to be opened and then a capsule inserted, the housing then being closed again. A pump or a suction system is used to expel the product contained in the capsule and mix it into a stream of water passing through the device. An adjusting plate that can be controlled by a lever is used to regulate the quantity of product expelled from the capsule. Also, U.S. Pat. No. 3,349,788 discloses a fluid mixer comprising a valve.

An idea underlying the invention is that of allowing a user to mix an encapsulated product into a stream of water using a device of little bulk. One object of the invention is also to provide a device that allows simple use in which the user has only a limited number of handling operations to perform in order to bring the product contained in a capsule into contact with a stream of water passing through the device.

In order to achieve that, the invention provides a diffusion device intended to accept a peripherally flanged capsule containing a product that is to be diffused into a stream of water, the device comprising:

- a body intended to be fixed to a water circuit;
- a bearing surface borne by the body directly or indirectly and forming a lower surface of a housing for a peripherally flanged capsule containing a water-soluble product;
- a passage for letting the product out of the capsule housing as far as an outlet of the passage;
- a knob mounted with the ability to rotate on the body, the knob comprising an upper part projecting in the direction of the axis of rotation of the knob beyond the bearing surface, the knob and the bearing surface being mounted with the capacity for helicoidal rotation one with respect to the other;
- the knob being able to be brought, in a closing movement with respect to the body, from a position in which the device is open, in which position the housing offers an opening of a dimension greater than a diameter of the flange of the capsule and intended to allow the flanged capsule to be inserted into the housing facing the bearing surface;
- the closure movement of the knob being able to bring the lower face of a rim of the device to face the bearing surface, the closure movement of the knob comprising a rotational movement of the knob with respect to the body causing a helicoidal movement between the knob and the bearing surface capable of bringing a lower face of the rim and the bearing surface closer together in order by compression to hold a peripheral portion of the flange of the capsule between the rim and the bearing surface in a sealed manner when the device is in a closed position.

Such a device allows for a space saving on installation, installation not requiring the provision of the space required for manipulating a hatch for opening the housing, the capsule being inserted via an opening of the housing and a simple turn of the knob being enough to close the device. In addition, the opening of the housing allows the capsule to be inserted simply and quickly into the housing.

In one particular embodiment, the device comprises:

- a cylindrical body extending in an axial direction, a periphery of an upper face of said body comprising a bearing surface, said bearing surface forming a lower face of a housing for a peripherally flanged capsule containing a water-soluble product;
- a water-supply passage passing through the body from a water inlet as far as the capsule housing and a water return passage passing through the body from the capsule housing as far as a water outlet;
- a knob mounted with the capacity for helicoidal rotation on the cylindrical body, the knob comprising an upper part for projecting in the axial direction of the cylindrical body beyond the bearing surface, the upper part of the knob having a rim a lower face of which faces the bearing surface of the body;
- a backing ring mounted with the ability to move in the body between the upper surface of the cylindrical body and a lateral face of the cylindrical body, said backing ring comprising a shoulder projecting in the axial direction of the cylindrical body beyond the bearing surface and a lower face of which faces a first portion of the bearing surface;
- the bearing surface, the lower face of an upper part of the knob and the lower face of the shoulder of the backing ring together forming a peripheral groove of the housing which groove is open toward the inside of the housing and intended to accept the flange of the capsule;
- the knob being able to move in a helicoidal closing movement with respect to the body from an open position in which the shoulder of the backing ring is at least partially housed in a groove of the upper part of the knob, the groove of the housing extending laterally over only part of the periphery of the housing, a second portion of the bearing surface of the body not facing the lower face of the upper part of the knob and not facing the shoulder of the backing ring either and defining a lateral opening of the housing;
- the closure movement of the knob being able to bring the lower face of the upper part of the knob to face the second portion of the bearing surface of the body and to bring the lower face of the upper part of the knob and the second portion of the bearing surface closer together in order by compression to keep a second peripheral portion of the flange of the capsule against the second portion of the bearing surface of the body in a sealed manner, the backing ring being coupled to the knob so as to be moved by the knob during the closure movement so as to bring the lower face of the shoulder of the backing ring and the first portion of the bearing surface closer together in order by compression to hold a first peripheral portion of the flange of the capsule against the first portion of the bearing surface of the body in a sealed manner.

According to this embodiment, such a device for diffusing an encapsulated product into a stream of water may have one or more of the following additional features.

In this preferred embodiment, the bearing surface is situated on an upper face of the body, the knob being mounted with the capacity for helicoidal rotation on the body.

In an alternative form of embodiment, a piston is mounted with the ability to move translationally in the body, the bearing surface being situated on a periphery of an upper face of the piston, the knob being mounted with the capacity for helicoidal rotation with the piston, the product return passage passing through the piston, a closure movement of the knob being able to move the piston translationally in the body in order to bring the lower face of the rim and the bearing surface closer together.

The device according to this embodiment advantageously allows the knob, in a simple movement that consists in effecting a rotation, for example of the order of 180°, to trap the flange of the capsule in the groove of the housing in a sealed manner between the bearing surface on the one hand and, on the other hand, the lower face of the upper part of the knob and the lower face of the shoulder of the backing ring. This sealing may be obtained for example through the presence of sealing beads on the flange of the capsule or alternatively the presence of a seal arranged on the upper face of the cylindrical body and having a bearing surface on its upper face.

For preference, the lower face of the rim develops over 360° about the axis of rotation of the knob, the bearing surface develops over 360° about the axis of rotation of the knob, the closure movement of the knob being able to bring the lower face of the rim to face the bearing surface over 360° so as to allow the flange of the capsule to be inserted in a sealed manner between said rim and the bearing surface over 360° when the device is in the closed position.

This embodiment ensures that, in use, the flange of the capsule is pressed by the lower face of the rim over the entirety of the peripheral flange of the capsule, making it possible to obtain a perfect seal in the housing of the device.

In one embodiment, the rim delimits with the bearing surface a peripheral groove of the housing which groove is open toward the inside of the housing and intended to accept the flange of the capsule, the opening of the housing when the device is in the open position being delimited by a portion of the bearing surface that does not face the lower face of the rim. The opening of the housing is preferably lateral but may equally be on an upper face of the knob. Such a lateral opening limits the amount of space needed to insert the capsule into the housing. The presence of the groove in such a lateral opening advantageously provides guidance for the capsule while it is being inserted. Furthermore, such a lateral opening allows stable insertion into the device whatever the positioning of the device in space if the opening is not oriented downward. Thus, if the device is installed on a downward facing surface such as the ceiling of a shower or the like, the user simply inserts the capsule via the lateral opening and closes the device without having to hold the capsule in position while closing the device.

In one embodiment, a backing ring is mounted such that it is translationally mobile in the body, said backing ring comprising a shoulder projecting in the axial direction of the body beyond the bearing surface, the rim of the device comprising a lower face of the shoulder, the backing ring being coupled to the knob so as to be driven by the knob in the closure movement so as to bring the lower face of the shoulder of the backing ring and the bearing surface closer together in order by compression to keep a portion of the flange of the capsule between the bearing surface and the lower face of the shoulder in a sealed manner.

One embodiment makes provision for the backing ring to comprise a skirt of a shape that complements a trench in the body, the skirt of the backing ring being inserted into the trench, a face of the skirt having axially extending ribs, the trench comprising axially extending grooves that complement the ribs of the skirt so as to guide the movement of the backing ring with respect to the body in an axial movement. Such a skirt makes it possible to limit the movement of the backing ring with respect to the body to a translational movement but this limitation of the movement may be obtained by any means known to those skilled in the art.

In one embodiment, the rim of the device comprises a lower face of the upper part of the knob, the lower face of the upper part of the knob constituting a first portion of the rim of the device, the lower face of the shoulder of the backing ring constituting a second portion of the rim of the device, the closure movement of the knob being able to bring the first portion of the rim to face a second portion of the bearing surface while at the same time bringing said first portion of the rim and said second portion of the bearing surface closer together and being able to bring the second portion of the rim to face a first portion of the bearing surface while at the same time bringing said second portion of the rim and the second portion of the bearing surface closer together so as to trap the flange of a flanged capsule between, on the one hand, the first portion of the bearing surface and the second portion of the rim and, on the other hand, the second portion of the bearing surface and the first portion of the rim.

The rim here is produced in two portions which together form a lower face intended to collaborate with the bearing surface, but other modes of embodiment are possible, for example with the rim being formed by a diaphragm such as those used in photographic equipment, the diaphragm in a retracted position having no face facing the bearing surface and, as it deploys, bringing the lower face of said diaphragm to face the bearing surface in order to form the peripheral groove.

In one embodiment, the first portion of the rim and the second portion of the rim are in distinct planes. Typically, the first portion of the rim and the second portion of the rim constitute a step in the groove of the housing which will guide the capsule as it is being inserted into the housing, said capsule also comprising a step that complements the step in the groove of the housing.

In one embodiment, the first portion of the rim has the shape of an arc of a circle with a first radius and the second portion of the rim has the shape of an arc of a circle with a second radius greater than the first radius and concentric with the first portion of the rim, when the device is in the open position, the shoulder of the backing ring being housed at least partially in a groove in the upper part of the knob.

In one embodiment, the first portion of the rim faces the bearing surface over half or more of the periphery of the bearing surface and the second portion of the rim faces the bearing surface over half or more of the periphery of the bearing surface.

Advantageously, the first portion and the second portion of the rim each develop over more than 180°, thus creating a region of overlap. The presence of a region of overlap in which, when the device is in the closed position, the flange is trapped by the bearing surface on the one hand and, on the other hand, by both the first portion of the rim and the second portion of the rim, completely guarantees the sealing of the housing. Advantageously, a first portion of the rim and a second portion of the rim each extend over, for example, 190° of the periphery of the device.

In one embodiment, the device comprises a water supply passage supplying water from a water inlet as far as the capsule housing. Such a water supply passage allows the housing to be supplied with water and offers better circulation of the product that is to be diluted in the stream of water. However, the expulsion of the product from the housing via the outlet passage may be obtained in a different way, for example using a Venturi effect. In the case of a device comprising an expulsion of the product using a Venturi effect, an element is preferably provided for letting air or water into the housing to ensure proper emptying of the capsule.

In an alternative form of this embodiment, the outlet passage and/or the water-supply passage pass through the body as far as the lower surface of the housing.

In one embodiment, the device comprises a water supply control element able to close off or uncover the water supply passage and/or the outlet passage, the control element being able to move in the device from a closed position in which the water return control element closes off the water supplying passage and/or the outlet passage as far as an open position in which the water supplying passage and/or the outlet passage is uncovered, the device comprising a return element applying a return force to the control element, said return force being able to keep the control element in the closed position when there is no opposing force applied to said control element, the device comprising a plate placed on an upper face of the body in the central region of the housing which region is surrounded by the bearing surface and able to move in the axial direction, the plate being coupled to the control element and being able to apply a thrust force to the control element, said thrust force causing the control element to move into the open position.

In one embodiment, the device comprises a puncturing mechanism intended to degrade a wall of a capsule inserted into the housing so as to create a communication between the inside of the capsule containing the product and the outside of the capsule.

In one embodiment, the puncturing mechanism comprises two puncturing pins borne by the body in such a way as to project in the axial direction in a central region of the housing which region is surrounded by the bearing surface, the device comprising a plate arranged in the central region of the housing which region is surrounded by the bearing surface and able to move in the axial direction between a deployed position in which the plate masks the pins and a retracted position in which the plate uncovers the puncturing pins. In an alternative form, the outlet passage comprises an inlet situated on an upper face of one of the pins of the puncturing mechanism.

In one embodiment, the body comprises on its upper face a cover of a shape that complements the plate, the pins being situated on the upper face of the body in the cover, a movement of the plate from its deployed position into its retracted position causing the water return control element to move into the open position.

Advantageously, the water supply control element is mechanically connected to the movement of the knob, said control element being in its closed position when the device is in an open position and passing to an open position upon a closure movement of the device when a capsule is inserted into the device. This mechanical connection between the rotation of the knob and the water supply control element makes use of the device simple, a user not having any additional operation to perform in order to open or close the water supply control element. This automation of the opening of the water supply control element also avoids leaks of water from the housing in the event of user oversight, there being no risk of the user opening the housing in order to insert a capsule therein when the water supply control element is open and the housing is being supplied with water.

The presence of the puncturing pins as above, associated with capsules of which one wall is made of a puncturable material that is intended to be punctured by the puncturing mechanism, allows the product contained in the capsule to be removed therefrom without the user having to open said capsule. Typically, the user inserts a capsule directly into the housing without having to worry about removing a film that seals the capsule or conditioning the capsule so that the product it contains can be brought into contact with the water flowing through the housing. The automation of the puncturing of the capsule avoids a user having to perform an additional operation such as pushing a pushbutton intended to deploy the pins into the housing so as to puncture the capsule. Furthermore, if the automating of the puncturing is connected with the opening of the supply of water to the housing (in a way that may or may not be automated), this automation of the puncturing guarantees that a capsule is punctured only when the control element is open and water is circulating through the housing so as to dissolve or remove the product contained in the capsule. Thus, a capsule that has been inserted into the housing without the device being closed is not punctured and can therefore be used later or, on the other hand, removed from the device without the product it contains becoming unusable.

In one embodiment, the body is mounted on a hollow mount comprising an inlet, an outlet and a passage for the stream of water between the inlet and the outlet of the mount. In a refinement, the outlet of the outlet passage is situated in a downstream part of the water passage of the mount and faces toward the outlet of the mount so as to create a reduced pressure at the outlet of the outlet passage.

For preference, the inlet of the water supply passage is situated in an upstream part of the water passage of the mount and oriented toward the inlet of the mount so as to divert a secondary stream of the stream of water. The location and orientation of the inlet of the water supply passage and of the outlet of the outlet passage respectively with respect to the inlet of the passage for the stream and the outlet of the passage for the stream ensures that the housing is correctly supplied with water and that the product to be diffused in the stream passing through the passage is diffused correctly.

In one embodiment, the housing comprises an opening at the center of the knob intended to allow a sealed body of the capsule to protrude beyond an upper face of the device.

This embodiment allows an exterior face of the sealed capsule to be left visible to a user without the need to open the housing. Thus, a user can, without manipulating the device, determine whether or not the housing thereof contains a capsule. Moreover, if the exterior face of the capsule bears information such as the nature of the product contained in the capsule or the like, this information is visible to the user without the user having to manipulate the device. In addition, ejecting the capsule once the capsule has been used becomes simpler and a user can press against the exterior surface of the capsule in order to take it out of the device. Furthermore, in this embodiment, if the capsule bears product level indications, for example if the capsule is translucent or has a translucent wall section that acts as a product level indicator, the user can see whether the capsule still contains active products or whether the capsule is spent without having to open the housing.

In one embodiment, the device further comprises a valve comprising the bearing surface and mounted with the capacity for axial translational movement in the body, the valve having the capacity for helicoidal rotational movement with respect to the knob.

In one particular embodiment, the body comprises a shoulder projecting in the axial direction of the body beyond the bearing surface, the rim of the device comprising a lower face of the shoulder, the valve being coupled to the knob to be driven in axial translation by the knob during the closure movement so as to bring the bearing surface and the lower face of the shoulder closer together so as by compression to hold a portion of the flange of the capsule between the bearing surface and the lower face of the shoulder in a sealed manner.

In one embodiment, the rim of the device comprises a lower face of the upper part of the knob, the lower face of the upper part of the knob constituting a first portion of the rim of the device, the lower face of the shoulder constituting a second portion of the rim of the device, the closure movement of the knob being able to bring the first portion of the rim to face a second portion of the bearing surface while at the same time bringing said second portion of the bearing surface and said first portion of the rim closer together and being able to bring the second portion of the rim to face a first portion of the bearing surface while at the same time bringing the first portion of the bearing surface and said second portion of the rim closer together so as to trap the flange of a capsule between, on the one hand, the first portion of the bearing surface and the second portion of the rim and, on the other hand, the second portion of the bearing surface and the first portion of the rim.

In one embodiment, the first portion of the rim faces the bearing surface over half or more of the periphery of the bearing surface and the second portion of the rim faces the bearing surface over half or more of the periphery of the bearing surface.

In one embodiment, the device further comprises a water supply passage supplying water from a water inlet as far as the capsule housing, and the outlet passage and the water supplying passage pass through the valve as far as the lower surface of the housing.

In one embodiment, the valve comprises a water supply control element surrounded in a sealed manner by a first seal borne by the body and by a second seal borne by the body, the first and second seals being spaced apart from one another in the axial direction of translational movement of the valve, the valve being able to move in the body, from a closed position in which the water inlet of the second passage and the outlet of the first passage are situated axially in line with the first seal so as to be closed off by the first seal as far as an open position in which the water inlet and the water outlet of the passage are situated in axial projection between the two seals and the water inlet and water outlet of the passage are uncovered.

In one embodiment, the device comprises a puncturing mechanism intended to degrade a wall of a capsule inserted into the housing so as to create a communication between the inside of the capsule containing the product and the outside of the capsule and in which the puncturing mechanism comprises two pins which are situated on an upper face of the valve so as to project in the axial direction in a central region of the housing which region is surrounded by the bearing surface when the knob is in the closed position, the device comprising a plate bearing the bearing surface and able to move in the axial direction with respect to the valve between a deployed position in which the plate masks the pins and a retracted position in which the plate uncovers the puncturing pins.

The invention also relates to a water distribution system comprising a water inlet connected to a diffusion head further comprising a device according to the invention installed in said diffusion head. For example, the device according to the invention may be installed in a shower head, the opening of the housing being situated on the part of the shower head opposite the diffusion rows.

In one embodiment, the body comprises a hollow mount comprising an inlet, an outlet and a passage for the stream of water between the inlet and the outlet of the mount, the outlet of the outlet passage being situated in a downstream part of the water passage of the mount and oriented toward the outlet of the mount so as to create a reduced pressure at the outlet of the outlet passage.

The invention will be better understood, and further objects, details, features and advantages thereof will become more clearly apparent during the course of the following description of a number of preferred embodiments of the invention which are given solely by way of nonlimiting example with reference to the attached drawings.

Figure 1:
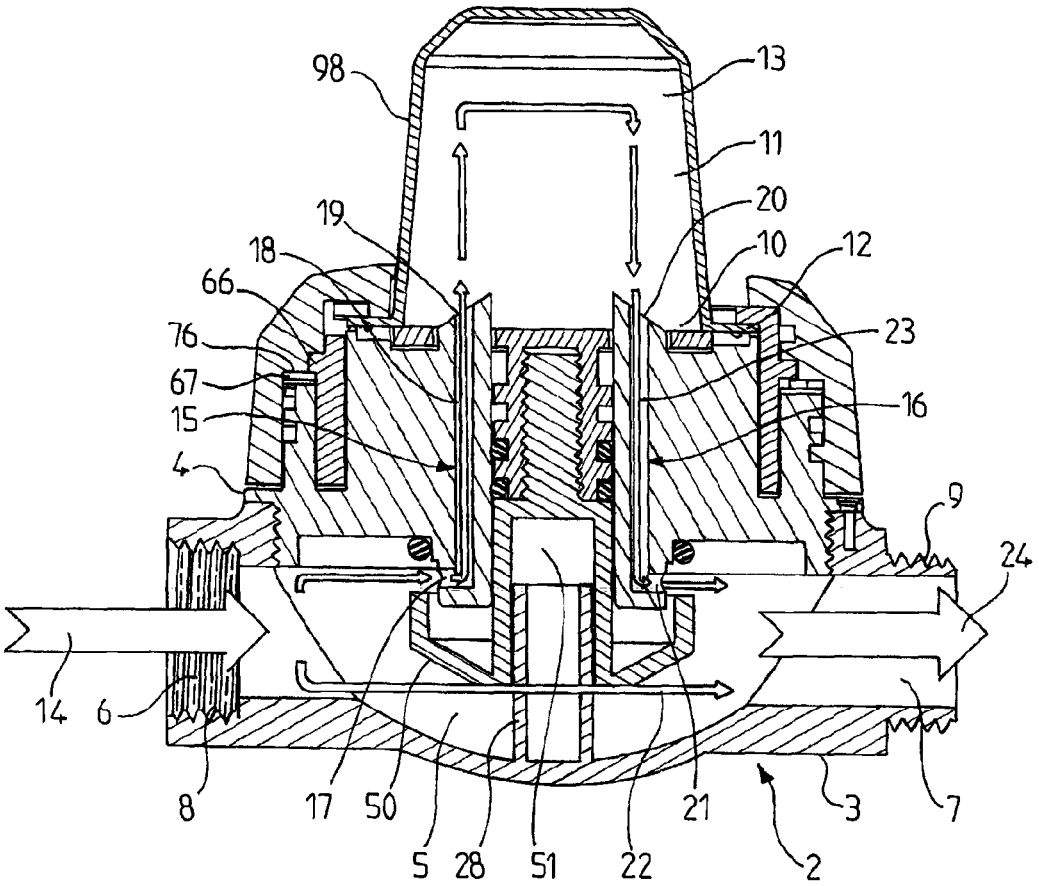
FIG. 1 is a view in cross section of a diffusion device in the closed position in which device a capsule is installed.
Figure 9:
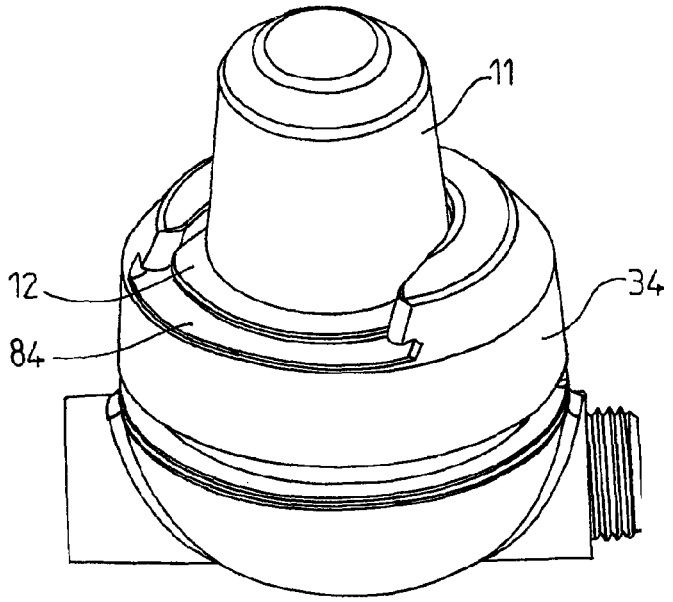
Figure 10:
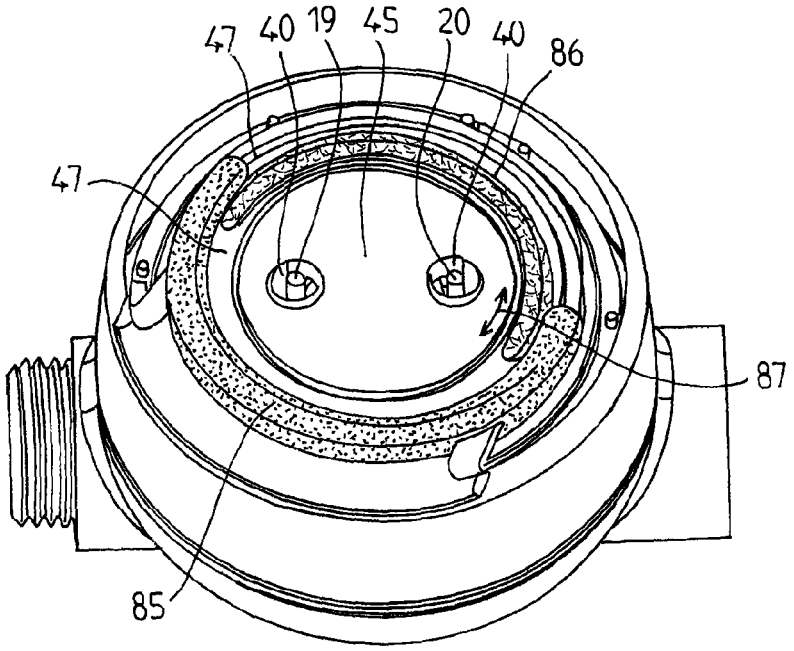
Figure 11:
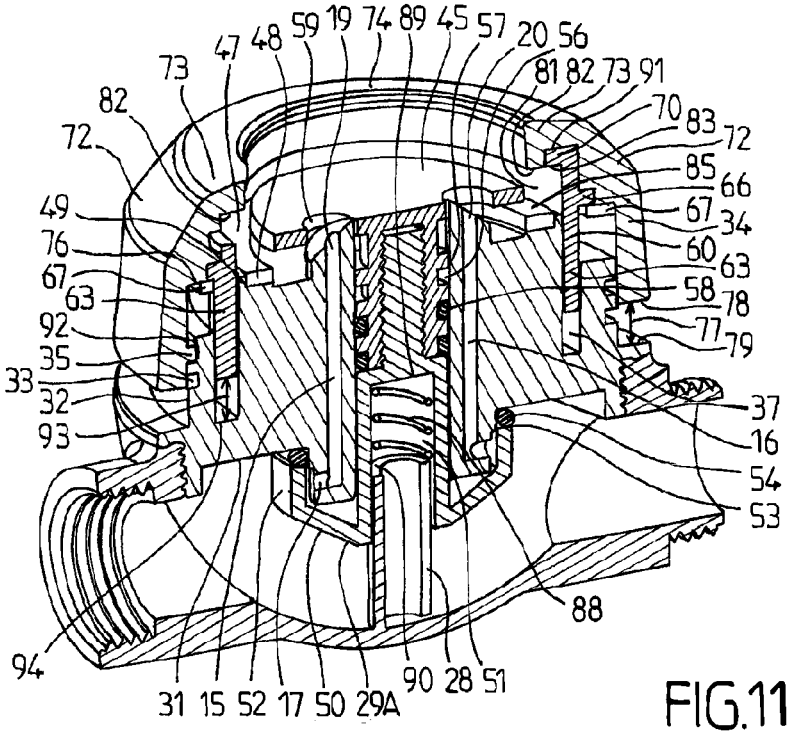
Figure 12:
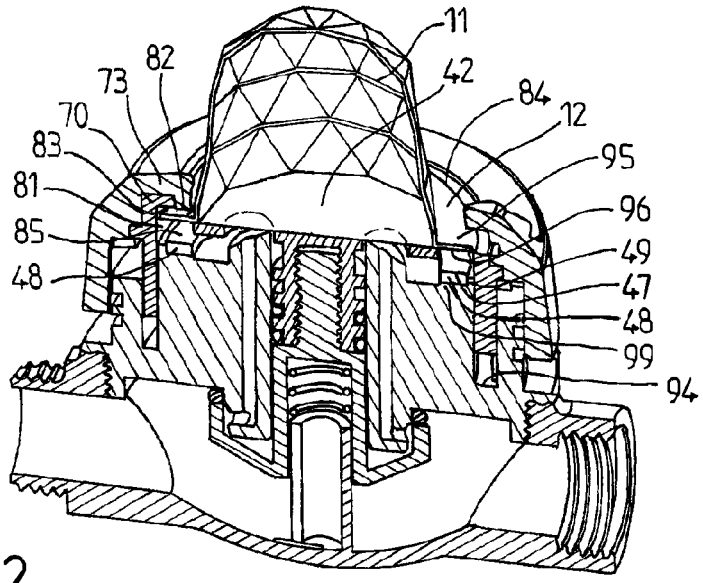
Figure 13:
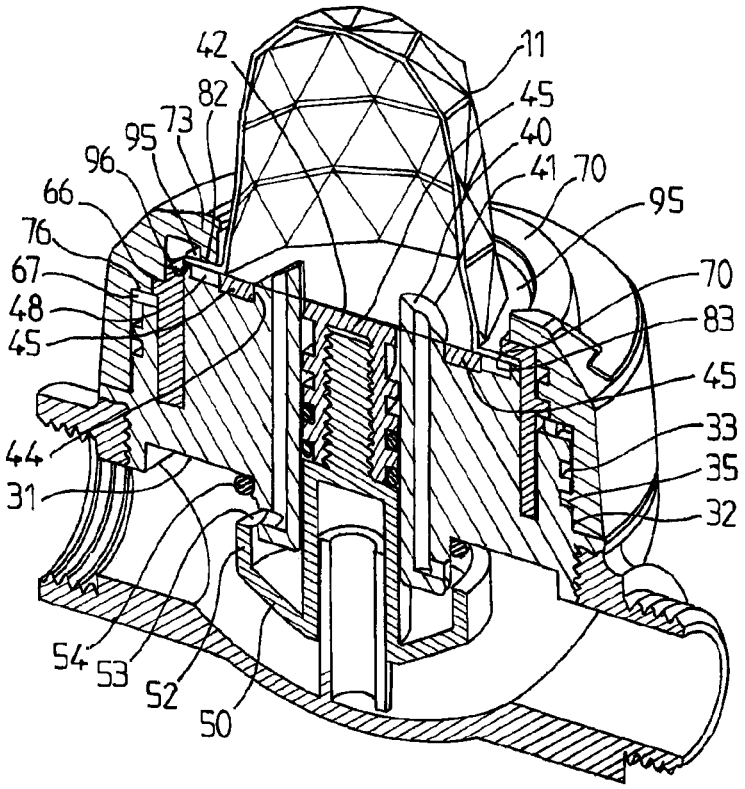
Figure 14:
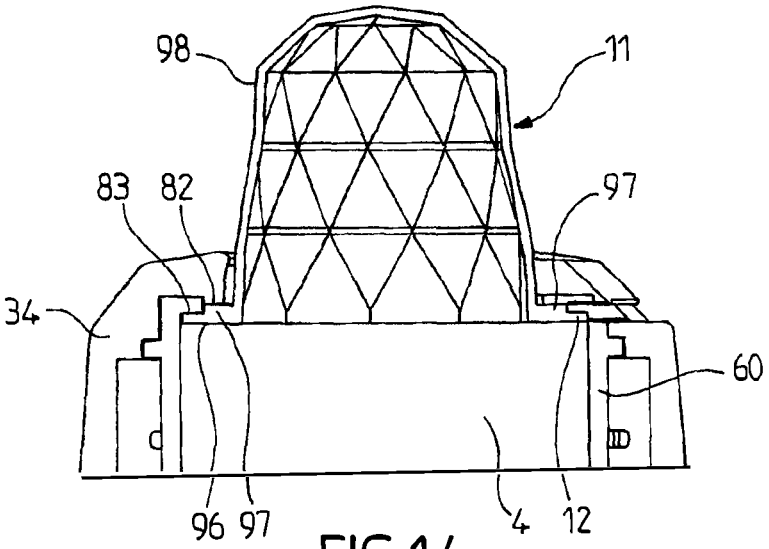
Figure 15:
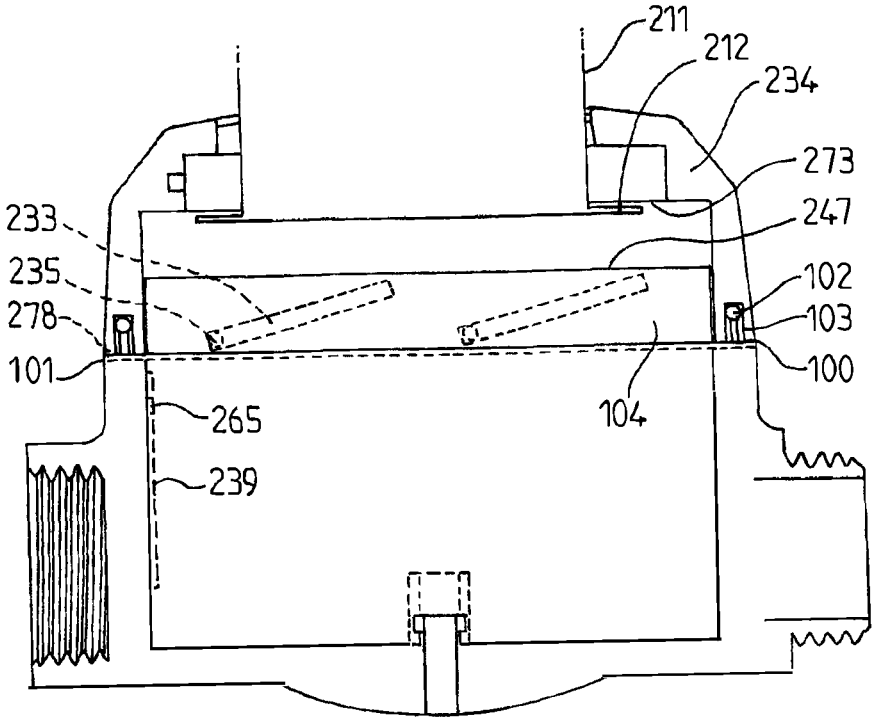
Figure 16:
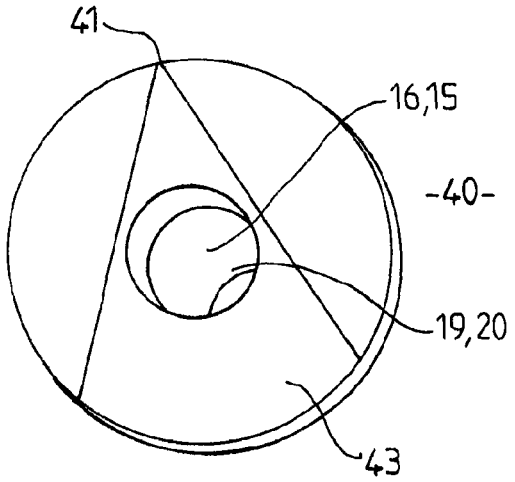
Figure 17:
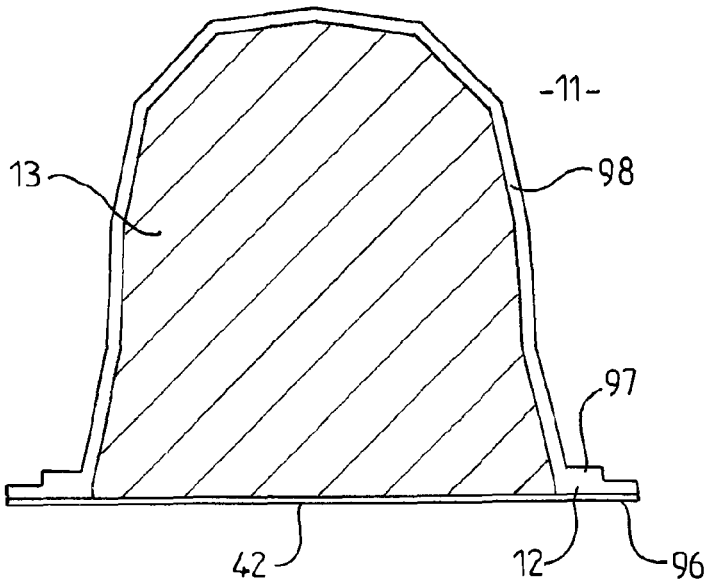
Figure 18A:
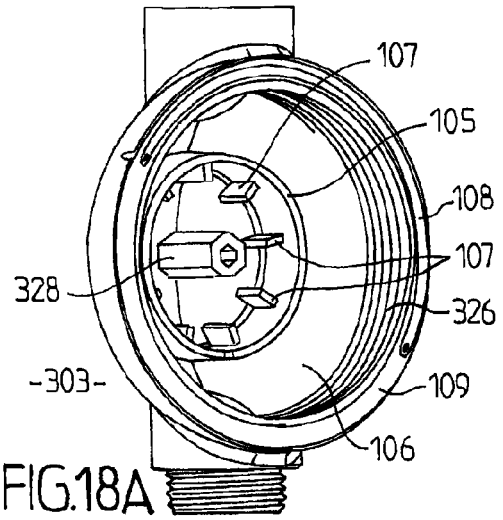
Figure 18B:
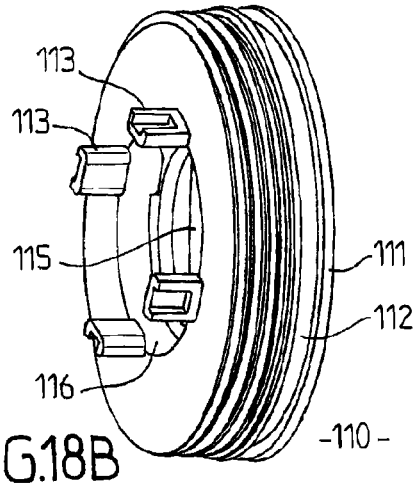
Figure 18D:
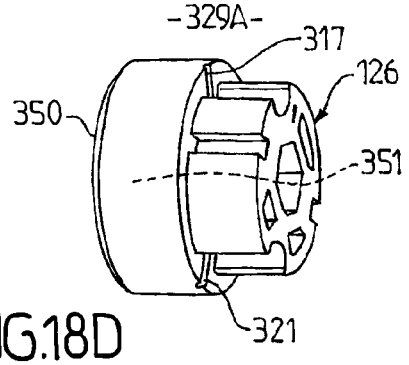
Figure 18E:
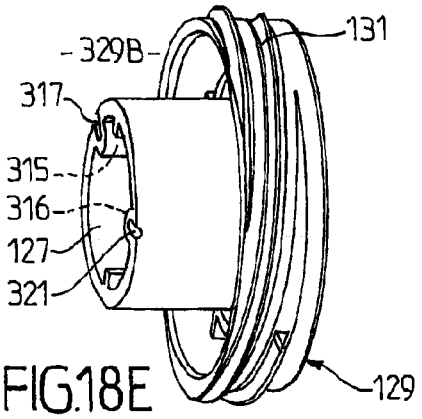
Figure 18F:
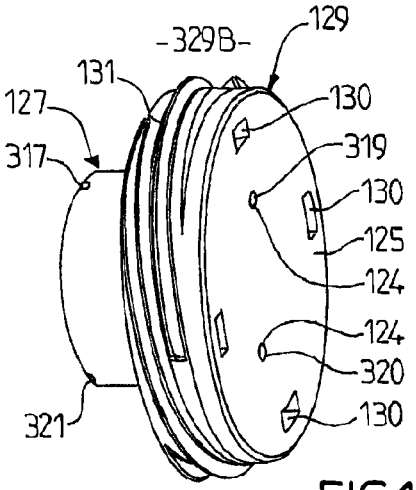
Figure 18G:
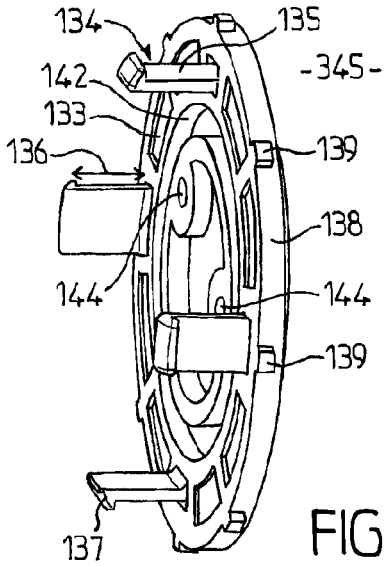
Figure 18C:
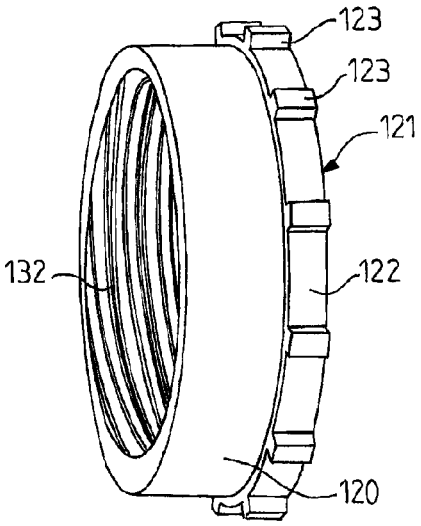
Figure 18J:
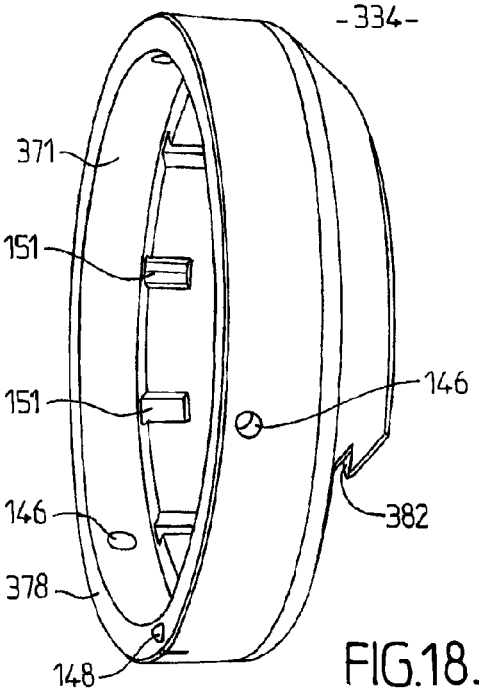
Figure 18H:
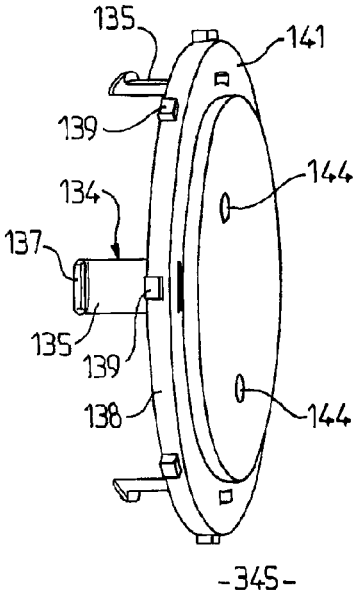
Figure 18I:
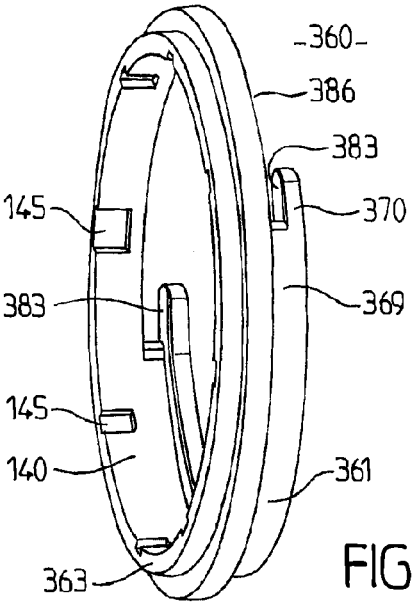
Figure 18K:
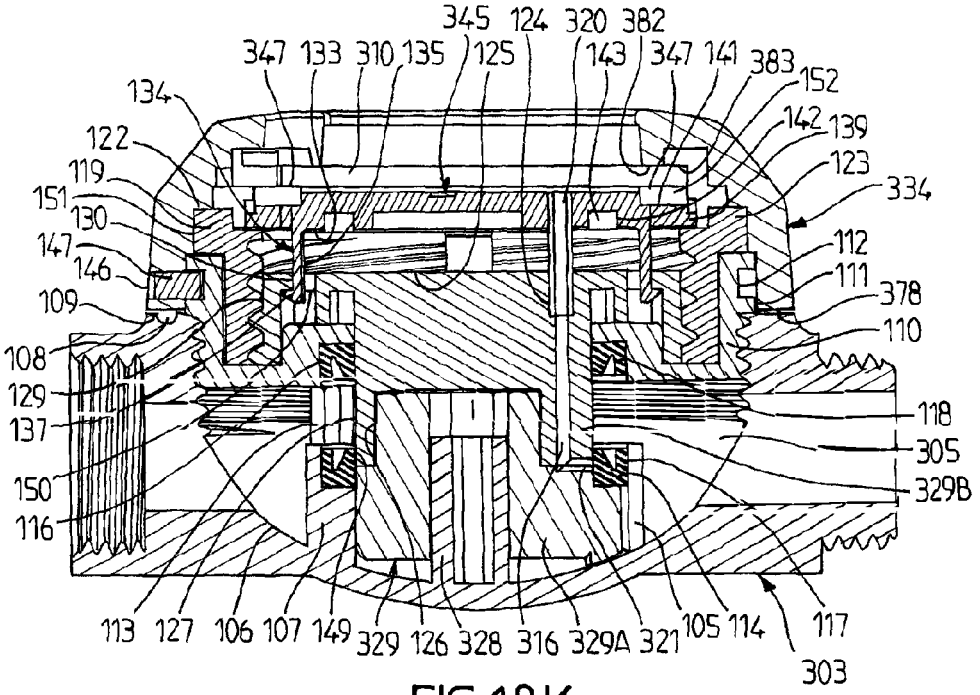
Figure 19:
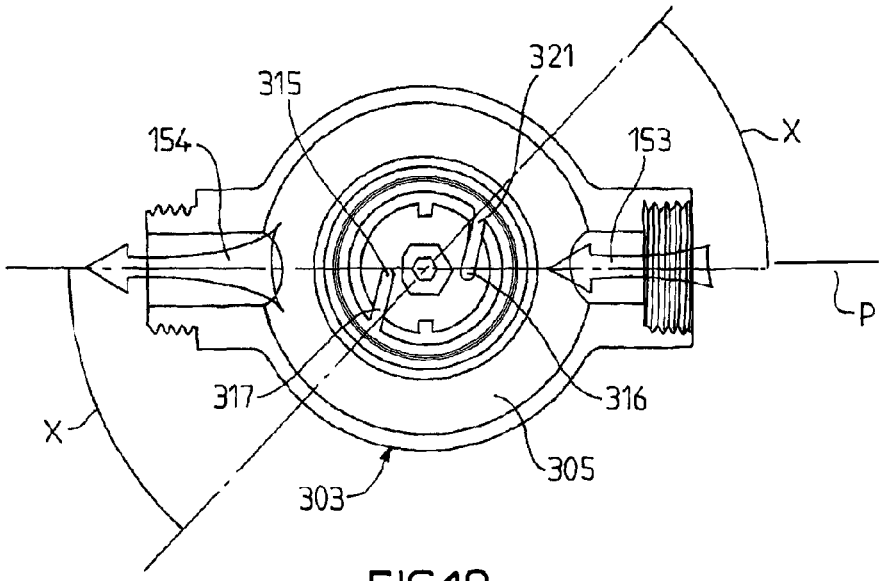

FIG. 9 is a perspective view of a device in the open position and with a capsule inserted in it FIG. 10 is a perspective view from above of the device of FIG. 1 in the closed position and without a capsule showing hidden detail of a first portion of the bearing surface intended to collaborate with a lower face of the shoulder of the backing ring and a second portion of the bearing surface intended to collaborate with the lower face of the upper part of the knob;

FIG. 11 is a perspective view in cross section of the device in the open position without a capsule;

FIG. 12 is a perspective view in cross section of the device in the open position and with a capsule inserted in it;

FIG. 13 is a perspective view in cross section of the device in the closed position and with a capsule inserted in it;

FIG. 14 is a view in cross section of an alternative form of embodiment of the device;

FIG. 15 is a view in cross section of an alternative form of embodiment of the device;

FIG. 16 is a view in cross section of an alternative form of embodiment of the pins of the puncturing device;

FIG. 17 is a view in cross section of a capsule that can be used in the device of FIG. 14;

FIGS. 18A to 18J are schematic perspective views of the constituent parts of the device in an alternative form of embodiment;

FIG. 18K is a view in cross section of the device comprising the elements of FIGS. 18A to 18J assembled with one another;

FIG. 19 is a view in horizontal section at the inlet of the water supply pipe and the outlet of the water return pipe of a device such as according to FIGS. 18A to 18K.

FIG. 1 depicts a diffusion device 1 in use. The device 1 comprises a mounting base 2 made up of a mount 3 on which a cylindrical body 4 or puncturing device 4 is mounted. The mount 3 and the puncturing device 4 are fixed relative to one another. The base 2 comprises a water passage 5 provided with a water inlet 6 and a water outlet 7.

The device 1 is intended to be installed on any existing water pipe in a sanitary installation, for example the water inlet 6 being directly screwed using a screw thread 8 of the water inlet 6 onto a shower tap (not depicted) and a shower hose (not depicted) being screwed onto it onto a screw thread 9 of the water outlet 7.

The diffusion device 1 may also be incorporated directly into existing devices or installations, for example into a shower head, a water inlet of the shower head constituting the water inlet 6 into the base 2 and the shower head rows constituting the water outlet 7 from the base 2, the base 2 potentially comprising a mixing chamber intended to allow the product to mix with the stream of water. Typically, the diffusion device may be installed at various points in a sanitary water distribution system, for example at a tap, in a shower head or some intermediate location between the tap and the shower head.

The diffusion device 1 allows an encapsulated product to be mixed into the water passing through said device 1. For that, the device comprises a housing 10 intended to accept a capsule 11 with a peripheral flange 12 containing a water soluble product 13. The product 13 contained in the capsule 11 may for example be soap, a cream, a foaming agent, a shampoo, a bodycare, skincare or haircare product, an antibacterial product, essential oils, detergent or any other liquid, gel, solid or water-soluble powder product.

In order to allow the product 13 to mix into a stream of water 14 entering the device 1, the device 1 comprises an element 15 for supplying water from the passage 5 of the base 2 as far as the housing 10 for a capsule 11 on the one hand and, on the other hand, an element 16 for returning water from the housing 10 for a capsule 11 as far as said water passage 5 in the base 2. Typically, the water supply element 15 supplying water from the passage 5 to the housing 10 is a water supply hose 15. The hose 15 supplying water to the housing 10 comprises a water supply inlet 17 situated in the passage 5, this water supply inlet 17 being situated upstream of the passage 5 and oriented in such a way as to divert part of the stream 14 as a secondary stream 18 circulating along the pipe 15. An outlet 19 of the pipe 15 opens directly into the housing 10 into which the capsule 11 is inserted. When the device is being used, the water supply outlet 19 ideally opens directly into a puncturable capsule 11, as can be seen in FIG. 1.

In the same way, the water return element 16 takes the form of a hose 16 that has an inlet 20 situated in the housing 10, or even inside the puncturable capsule 11 when the device is in use, as well as an outlet 21 which opens directly into the passage 5 downstream of said passage 5 and is directed toward the water outlet 7 from the base 2. The positioning of the water supply inlet 17 downstream of the passage 5 creates a raised pressure in the capsule 11 as the secondary stream 18 enters said capsule. Likewise, the positioning of the water return outlet 20 downstream of the passage 5 creates a reduced pressure in the capsule which, combined with the raised pressure created by the entry of the secondary stream 18, allows a secondary stream 23 of water laden with product to be expelled into the passage 5.

As can be seen in FIG. 1, in use, a stream 14 of water is introduced into the device 1. A secondary stream 18 is diverted from this stream 14 of incoming water by the water supply hose 15 while a main stream 22 circulates along the passage 5 as far as the outlet 7 of the mounting base 2. The secondary stream 18 is conveyed via the water supply hose 15 as far as the housing 10 in which it is brought into contact with the product 13 contained in the cartridge 11. A secondary flow 23 laden with product 13 is then returned via the water return hose 16 to the passage 5 where it mixes with the main stream 22 in order to provide a stream 24 of water laden with product at the outlet 7 of the base 2.

Reference is made to FIGS. 2 to 7 which show the constituent elements of the device 1 according to a preferred embodiment.

Figure 2:
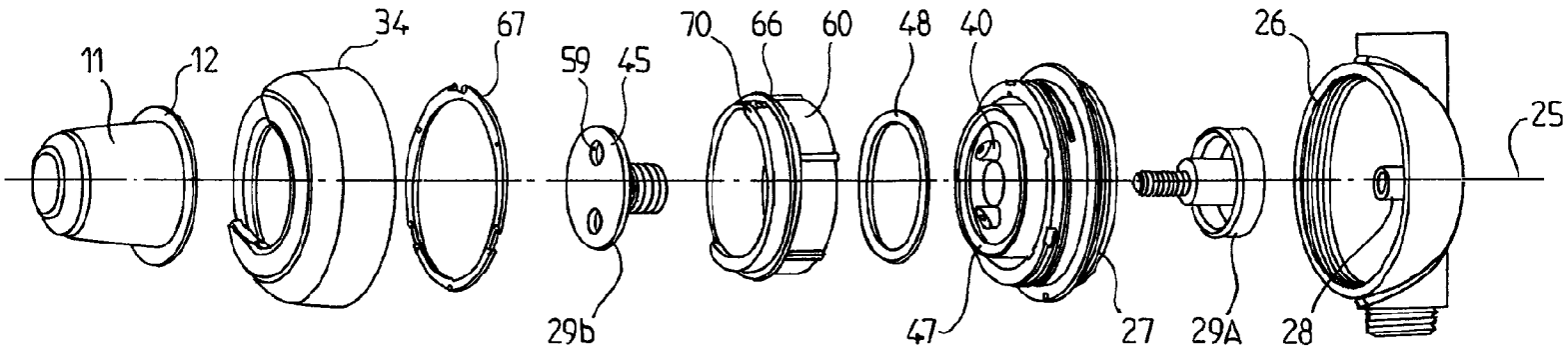
FIG. 2 is an exploded perspective view of the device of FIG. 1.

FIG. 2 shows the constituent elements of the device 1 in an exploded view spaced out along an axis 25 of assembly of the device 1. Certain elements of the device 1 are described in greater detail with reference to specific figures devoted to them.

The mount 3 comprises a screw thread 26 intended to collaborate with a lower screw thread 27 of the puncturing device 4. The mount 3 also comprises a guide 28 intended to guide a valve 29 in translational movement along the axis 25.

Figure 3:
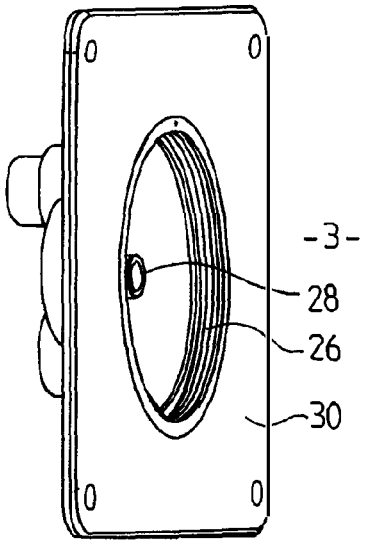
FIG. 3 is a perspective view of one embodiment of an alternative form of the mount of the device of FIG. 1.

FIG. 3 depicts an alternative form of embodiment of the mount 3 in which alternative form the mount 3 is intended to be set into a wall, the wall of a shower, the wall of a bath tub or of a Jacuzzi, a shower column or the like. It has the same elements as the mounts 3 depicted in the other figures but in a different configuration so as to allow it to be incorporated into the built-in installation. Thus, in addition to having the screw thread 26 intended to collaborate with the lower screw thread 27 of the puncturing device, the mount 3 depicted in FIG. 3 comprises a fixing plate 30 that for example allows it to be fixed to a wall panel. In an alternative form of embodiment, the mount 3 could also be incorporated directly into the body of a tap.

Figure 4:
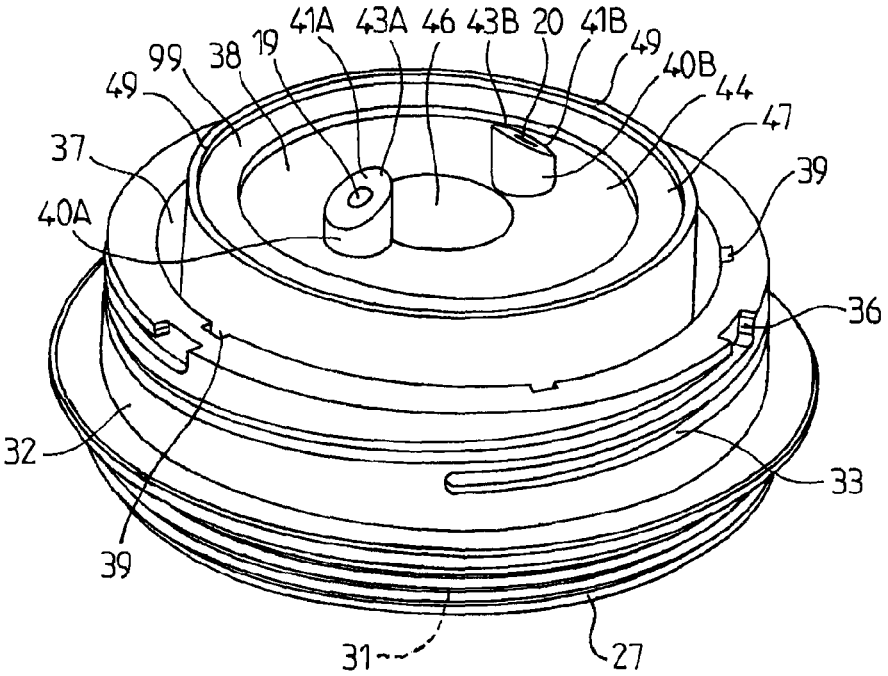
FIG. 4 is a perspective view of a base of the device of FIG. 1.

FIG. 4 depicts a perspective view of a puncturing device 4 of the base 2. A lower face 31 of the puncturing device, together with the mount 3, delimits the passage 5. A lateral face 32 of the puncturing device 4 comprises a lateral screw thread 33. This lateral screw thread 33 is intended to collaborate with a knob 34, more particularly with internal spikes 35 of the knob 34. Tightening guides 36 on the lateral face 32 of the puncturing device 4 allow the spikes 35 to be inserted in the lateral screw thread 33 of the puncturing device 4 by translation along the axis 25 of these spikes.

The puncturing device 4 comprises a trench 37 situated between an upper face 38 of the puncturing device 4 and the lateral face 32 thereof. This trench 37 has grooves 39 developing parallel to the axis 25.

The upper face 38 of the puncturing device 4 comprises a puncturing mechanism in the form of two chamfered pins 40 that have an upper end 41 able to puncture a wall 42 of the capsule 11. Advantageously, the outlet 19 of the hose 15 supplying water to the housing 10 and the inlet 20 of the hose 16 returning water to the passage 5 are situated on upper faces 43 of a first pin 40A and of a second pin 40B respectively. Locating the outlet 19 of the water supply pipe 15 on an upper face 43A of the first pin 40A allows the secondary stream of water 18 to open directly into the capsule 11 in use, the upper end 41A of the first pin 40A having passed through the wall 42 of the capsule 11. Likewise, locating the second pin 40B for the inlet 20 of the water return pipe 16 into the passage 5 on the upper face 43B ensures that the secondary stream 23 of laden water is removed correctly from the capsule 11 to the passage 5. The first pin 40A and the second pin 40B are both situated in a circular cover 44 situated on the upper face 38 of the puncturing device and intended to accept a plate 45 of the valve 29. The puncturing device 4 further comprises a central circular orifice 46 passing through the puncturing device 4 along the axis 25. The pins 40 may have any shape that allows them to degrade a wall of the capsule so as to allow the product to escape from the capsule. Thus, the pins 40 may have a spiked shape as depicted in FIG. 16.

The puncturing device 4 on a periphery of its upper face 38 comprises a receptacle 99 for a seal 48. The receptacle 99 extends around the periphery of the upper face 38 around the cover 44. The seal 48 is housed in this receptacle and mechanically held in position for example using a bead 49. The seal 48 on an upper face comprises a bearing surface 47, said upper surface of the seal 48 being the opposite face to the face of the seal 48 in contact with the upper face 38 of the puncturing device 4. In an embodiment that has not been depicted, the upper face 38 of the puncturing device 4 has no receptacle 99 and no bead 49 for the seal 48, the bearing surface 47 being incorporated directly into said upper face 38 of the puncturing device, a sealing bead in this case being provided on the flange 12 of the capsule 11.

Figure 5A:
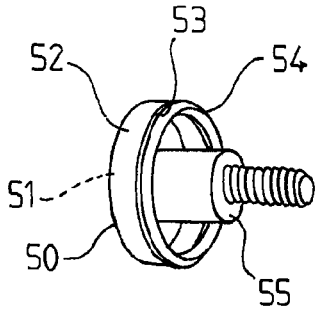
FIGS. 5A and 5B are perspective views of, respectively, a first part and a second part of a valve of the device of FIG. 1.
Figure 5B:
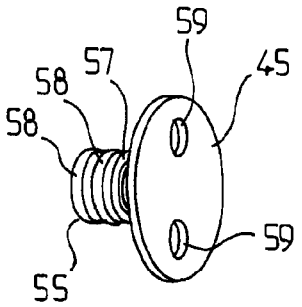

FIGS. 5A and 5B respectively depict a lower part 29A or water supply control element 29A, and an upper part 29B of the valve 29. The valve 29 is of circular cylindrical overall shape. The lower part 29A of the valve comprises a chamfered lower face 50 (see FIG. 1). This chamfered lower face 50 comprises a central orifice 51 that complements the guide 28 of the mount 3, said guide 28 being intended to be inserted in the orifice 51 of the chamfered lower face 50 so as to guide the valve 29 as the latter moves translationally in the device 1. A lateral wall 52 of the lower part 29A of the valve 29 develops from the chamfered lower face 50 toward the upper part 29B of the valve 29. In use, an upper face 53 of the lateral wall 52 of the valve 29 collaborates with a seal 54 installed on the lower face 31 of the puncturing device 4 so as to close or open the inlet 17 of the pipe 15 supplying water to the housing 10 and the outlet 21 of the pipe 16 returning water to the passage 5.

The lower part 29A of the valve 29 is secured to the upper part 29B of the valve 29 by any means known to those skilled in the art, for example by screw fastening. A central section 55 of the valve 29, which may potentially be made up jointly by the lower part 29A and the upper part 29B of the valve 29, complements the central orifice 46 of the puncturing device 4. Lateral housings 56 are situated on a lateral exterior face 57 of this central section 55 so as to accept seals 58 that guarantee the sealing of the valve 29 in the central orifice 46 of the puncturing device. This central section 55 connects the plate 45 of the upper part 29B of the valve 29 to the chamfered lower face 50 of the lower part 29A of the valve 29. The plate 45 is of a shape that complements the cover 44 provided in the upper face 38 of the puncturing device 4. The plate has two through-orifices 59 that complement the pins 40 of the puncturing device 4.

Figure 6:
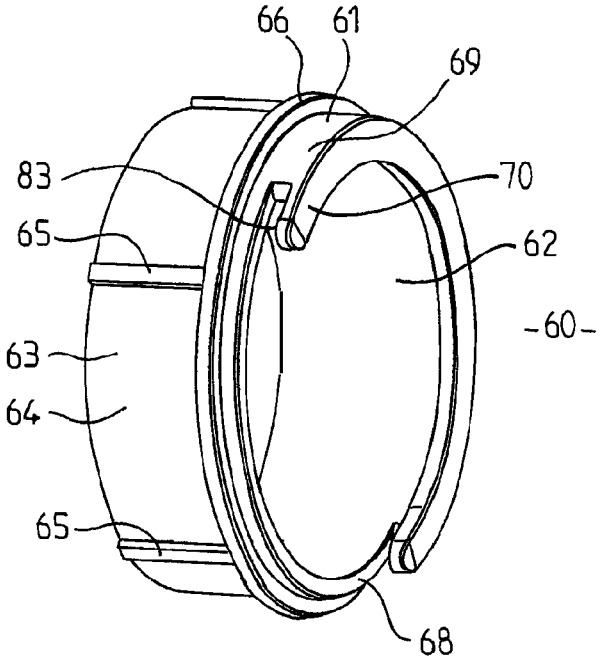
FIG. 6 is a perspective view of a backing ring of the device of FIG. 1.

FIG. 6 depicts a backing ring 60 of the device according to FIG. 1. This backing ring 60 has a hollow circular cylindrical overall shape, a lateral wall 61 delimiting a hollow central part 62 that complements the puncturing device 4. The backing ring 60 comprises a lower skirt 63 that complements the trench 37 of the puncturing device 4. This skirt 63 on an exterior face 64 has ribs 65 complementing the grooves 39 of the trench 37 of the puncturing device 4. The backing ring 60 comprises a lateral exterior clearance 66 intended to collaborate with a retaining ring 67 fixed in the knob 34. The backing ring 60 also comprises on a peripheral upper face 68 of the lateral wall 61 a step 69 which develops in the continuation of said lateral wall 61. This step 69 develops over 180° of the peripheral upper face 68. The step 69 has a circular shoulder 70 protruding toward the inside of the backing ring 60. This shoulder 70 develops preferably over 190° of the periphery of the backing ring 60, the shoulder 70 then preferably projecting into the backing ring 60 over two peripheral portions of the backing ring 60 of 5° on each side of the peripheral portion of the backing ring comprising the 180° of the step 69.

Figure 7:
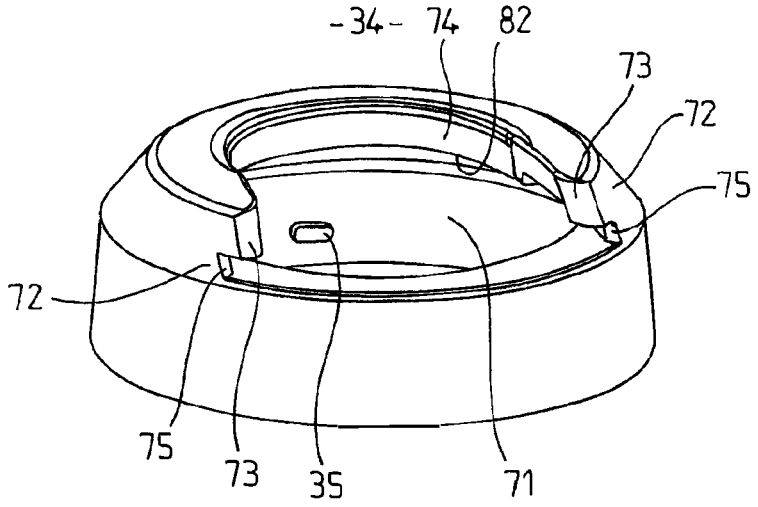
FIG. 7 is a perspective view of a knob of the device of FIG. 1.

FIG. 7 depicts a perspective view of a knob 34 of the device of FIG. 1. The internal spike 35 of the knob 34 which is intended to collaborate with the clamping guide 36 then with the lateral screw thread 33 of the puncturing device 4 is situated on an internal face 71 of the knob 34. The knob 34 constitutes the part for grasping of the device that the user will turn in order to open or close the device 1. The knob 34 comprises an upper part 72 having a lower face 82 extending as a projection toward the inside of the knob 34. In the preferred embodiment depicted here, the knob 34 comprises an upper opening 74 that complements the shape of the capsule. The upper part 72 of the knob 34 develops over 180° of the periphery of the knob 34. The lower face 82 of the upper part 72 of the knob 34 extends over 190° of the periphery of the knob 34, the lower face 82 preferably projecting toward the inside of the knob 34 over 5° of the periphery of the knob on either side of a circular end 75 of the upper part 72. The retaining ring 67, visible in FIG. 2, is intended to be fixed against a lower internal face 76 of the knob 34; this retaining ring 67 is intended to flank the external lateral clearance 66 of the backing ring 60, thus keeping said external lateral clearance 66 between the knob 34 and said retaining ring 67.

Figure 8:
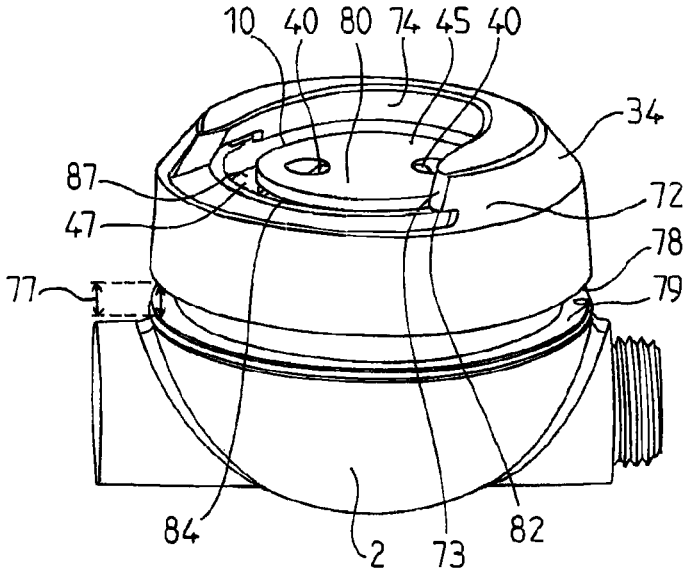
FIG. 8 is a perspective view of a diffusion device in the open position.

FIG. 8 depicts a perspective view of the device 1 with the device in the open position. In the open position, there is a space 77 between a lower face 78 of the knob 34 and a rim 79 of the base 2. The housing 10 is delimited by an upper face 80 of the plate 45 of the valve 29 and the upper opening 74 of the knob 34. The housing 10 comprises a lateral groove 81 open toward the inside of the housing 10. This lateral groove 81 of the housing 10 is delimited by the lower face 82 of the upper part 72 of the knob 34 and/or a lower face 83 (see FIG. 6) of the shoulder 70 of the step 69 of the backing ring 60 on the one hand and, on the other hand, by the bearing surface 47 of the seal 48, the lower face 82 of the upper part 72 of the knob 34 and the lower face 83 of the shoulder 70 of the step 69 of the backing ring 70 jointly forming the lower face of a rim 73 intended to compress the flange 12 against the bearing surface 47. An end wall of the lateral groove 81 of the housing 10 is delimited by the step 69 of the backing ring 60 or the upper part 72 of the knob 34. The upper opening 74 of the knob 34 also constitutes an upper opening for the housing 10. The housing 10 also has a lateral opening 84 corresponding to a region of the periphery of the puncturing device 4 over which region neither the 180° of the step 69 of the backing ring 60 nor the 180° of the upper part 72 of the knob 34 extend, which means to say that the opening 84 corresponds to a peripheral region of the housing in which region neither the step 69 of the backing ring 60 nor the upper part 72 of the knob 34 is present. FIG. 8 shows the plate 45 the orifices 59 of which do not have the pins 40 of the puncturing device 4 passing through them, the upper end 41 of the pins 40 lying flush with the upper face 80 of the plate 45.

When the device 1 is in the open position, the lower face 82 of the upper part 72 of the knob 34 and the lower face 83 of the shoulder 70 of the step 69 of the backing ring 60 both face a first portion 85 of the bearing surface 47. When the device is in the open position, a second portion 86 of the bearing surface 47, which is distinct from the first portion 85 of the bearing surface 47, faces neither the lower face 83 of the shoulder 70 of the step 69 of the backing ring 60 nor the lower face 82 of the upper part 72 of the knob 34. When the device is in the open position, it is possible to insert a capsule 11 into the housing 10 via the lateral opening 84 of the housing 10. The device 1 in the open position in which a capsule has been inserted can be seen in FIG. 9.

In order to close the device 1, a user needs to turn the knob 34. The rotating of the knob 34 does not cause the backing ring 60 to rotate. The rotation of the knob 34 and the absence of rotation of the backing ring 60 causes the upper part 72 of the knob 34 to turn with respect to the step 69 of the backing ring 60. When the knob rotates through 180°, the lower face 83 of the shoulder 70 of the step 69 remains facing a first portion 85 of the bearing surface 47 while the lower face 82 of the upper part 72 of the knob 34 comes to face a second portion 86 of the bearing surface 47 that is distinct from the first portion 85 of the bearing surface 47. The housing 10 is thus closed, the lateral opening 84 of the housing 10 being closed off by the upper part 72 of the knob 34 and not allowing a capsule 11 to be inserted into or removed from the housing 10.

The configuration depicted in FIG. 10 shows the first portion 85 of the bearing surface 47 which is intended to collaborate with the lower face 83 of the shoulder 70 of the backing ring 60 and the second portion 86 of the bearing surface 47 intended to collaborate with the lower face 82 of the upper part 72 of the knob 34. The lower face 83 of the shoulder 70 of the step 69 of the backing ring 60 and the lower face 82 of the upper part 72 of the knob 34 both extend over 190°. As a result, turning the knob 34 through 180° leads to the creation of regions 87 in which the bearing surface 47 simultaneously faces the lower face 83 of the shoulder 70 and the lower face 82. This configuration is particularly advantageous insofar as it allows the flange 12 of the capsule 11 to be clamped firmly over the entire periphery of the housing 10.

FIGS. 11 to 13 depict views in cross section of the device at various stages in the use thereof. In the embodiment depicted in FIGS. 11 to 13, the bearing surface 47 is situated on the peripheral seal 48.

In use, the guide 28 of the mount 3 is housed in the orifice 51 of the chamfered lower face 50 of the lower part 29A of the valve 29. A return element 88, such as a return spring 88, is situated between an end wall 89 of the orifice 51 of the chamfered lower face 50 of the lower part 29A of the valve 29 on the one hand and, on the other hand, an upper face 90 of the guide 28 of the mount 3. The return spring 88 applies, along the axis 25, a return force to the valve 29 keeping the latter away from the mount 3 and ensuring, in the absence of an opposing force, contact between the upper face 53 of the lateral wall 52 of the lower part 29A of the valve 29 and the seal 54 of the lower face 31 of the puncturing device 4. If there is a stream 14 flowing along the passage 5, this stream also applies to the chamfered lower face 50 of the valve 29 a force which also tends to push the valve 29 back and maintain contact between the upper face 53 of the wall 52 of the lower part 29A of the valve 29 and the seal 54 of the lower face 31 of the puncturing device 4. The external lateral clearance 66 of the backing ring 60 is housed between the knob 34 and the retaining ring 67. The skirt 63 of the backing ring 60 is housed in the trench 37 of the puncturing device 4. Likewise, the ribs 65 of the lateral outer face 64 of the skirt 63 are housed in the grooves 39 of the trench 37.

FIG. 11 depicts a view in cross section of the device 1 in an open position and without a capsule. When the device 1 is in the open position, the upper face 53 of the lateral wall 52 of the lower part 29A of the valve 29 is in contact with the seal 54 and the water supply pipe 15 and the water return pipe 16 are both closed. With the device 1 in this open position, the plate 45 of the valve 29 is situated outside the cover 44 of the puncturing device 4 and the pins 40 do not pass through the orifices 59 in said plate 45. The shoulder 70 of the step 69 of the backing ring 60 is housed in a groove 91 of the lower face 82 of the upper part 72 of the knob 34. Furthermore, the lower face 83 of the shoulder 70 of the step 69 of the backing ring 60 and the lower face 82 of the upper part 72 of the knob 34 both face the first portion 85 of the bearing surface 47. The spikes 35 of the knob 34 are level with a joining region 92 where the lateral screw thread 33 of the puncturing device 4 meets the tightening guide 36. A space 93 separates the skirt 63 from an end wall 94 of the trench 37, this space 93 providing the skirt 63 with the latitude for transverse movement. Likewise, the space 77 is present between the lower face 78 of the knob 34 and the rim 79 of the base 2 so as to allow the knob 34 latitude for axial movement with respect to the base 2.

FIG. 12 shows the diffusion device in an open position such as in FIG. 11, in which a capsule 11 with a flange 12 is present in the housing 10. The capsule 11 has been inserted via the lateral opening 84 of the housing 10 as visible in FIG. 8. Upon insertion of the capsule 11 into the housing 10, the flange 12 of the capsule 11 becomes inserted in the lateral groove 81 of the housing 10. An upper face 95 of the flange 12 faces the lower face 82 of the upper part 72 of the knob 34 and/or the lower face 83 of the shoulder 70 of the step 69 of the backing ring 60. A lower face 96 of the flange 12 faces the bearing surface 47 of the seal 48. The puncturable wall 42 of the capsule 11 faces the plate 45 of the valve 29, or is even in contact with said plate 45.

In an alternative form of embodiment, the lower face 83 of the shoulder 70 of the step 69 of the backing ring 60 and the lower face 82 of the upper part 72 of the knob are situated in the same plane, the space between the plane in which the plate 45 is situated and the plane in which the lower face 83 of the shoulder 70 and the lower face 82 are situated being slightly greater than the thickness of the flange 12 of the capsule 11, said flange 12 developing in the continuation of the puncturable wall 42 of the capsule 11. In this alternative form, the capsule 11 is guided in insertion by collaboration of the puncturable wall 42 with the plate 45 and of the upper face 95 of the flange with the lower face 82 and the lower face 83 of the shoulder 70.

In another alternative form that can be seen in FIG. 14, the flange 12 has a step 97. Such a capsule 11 of which the flange 12 has a step 97 is depicted with reference to FIG. 17. The lower face 82 and the lower face 83 of the shoulder develop in distinct planes. A space between the plane of the plate 45 and the lower face 82 is slightly greater than the thickness of the step 97 of the flange 12. A space between the plane of the plate 45 and the lower face 83 of the shoulder 70 is slightly greater than the thickness of the flange without the step 97. This alternative form provides optimal guidance of the flange 12 as the capsule 11 is being inserted into the housing 10.

When the knob 34 is turned to close, collaboration between the lateral screw threads 33 of the puncturing device 4 and the spikes 35 of the knob 34 forces the knob 34 to effect a helicoidal movement with respect to the puncturing device 4. The knob 34 presses against the external lateral clearance 66 of the backing ring 60 causing said backing ring 60 to move. However, the abutment of the ribs 65 against internal faces of the grooves 39 of the trench 37 prevents the backing ring 60 from turning, limiting its movement to a translational movement along the axis 25 with respect to the puncturing device 4. The helicoidal rotation of the knob 34 brings the lower face 78 of the knob 34 and the rim 79 of the base 2 closer together. Likewise, the translational movement of the backing ring 60 brings the skirt 63 of the backing ring 60 and the end wall 94 of the trench 37 closer together. During the closure movement, the lower face 82 of the upper part 72 of the knob 34 presses against the upper face 95 of the flange 12. Likewise, translational movement of the backing ring 60 forces the lower face 83 of the shoulder 70 of the step 69 of the backing ring 60 to bear against the upper face 95 of the flange 12. These pressures on the flange 12 of the capsule 11, applied respectively by the lower face 82 and by the lower face 83 of the shoulder 70, force the capsule 11 to move translationally along the axis 25. During this movement of the capsule 11, the lower face 96 of the flange 12 of the capsule 11 presses against the plate 45 of the valve 29, applying to the valve 29 a force that opposes the force applied by the return spring 88 and causing the valve 29 to move axially along the axis 25. The pressure of the lower face 96 of the flange 12 of the capsule 11 on the plate 45 of the valve 29 pushes the plate 45 back into the cover 44 of the puncturing device 4. As the plate 45 is pushed back into the cover 44, the pins 40 come through said plate 45, the upper end 41 of the pins 40 thus puncturing the puncturable wall 42 of the capsule 11 resting against the upper face 80 of the plate 45. Further, the section 55 of the valve 29 slides in the central orifice 46 of the puncturing device 4 and the upper face 53 of the lateral wall 52 of the lower part 29A of the valve 29 moves away from the seal 54 of the lower face 31 of the puncturing device 4. The movement of the seal 54 away from the upper face 53 simultaneously opens the pipe 15 that supplies water to the housing 10 and the pipe 16 that returns water to the passage 5. Finally, the pressure of the lower face 82 of the upper part 72 of the knob 34 and of the lower face 83 of the shoulder 70 of the step 69 of the backing ring 60 brings the lower face 96 of the flange 12 of the capsule 11 into sealed contact with the bearing surface 47 of the seal 48.

FIG. 13 depicts a perspective view of the device in a closed position, a capsule 11 being inserted in the housing 10, the knob 34 having been rotated by the order of 180° with respect to the device of FIG. 12. In the region of the first portion 85 of the bearing surface 47, the flange 12 of the capsule 11 is trapped in a sealed manner between the lower face 83 of the shoulder 70 of the step 69 of the backing ring 60 and the first portion 85 of the bearing surface 47 of the seal 48. In the region of the second portion 86 of the bearing surface 47, the flange 12 of the capsule 11 is trapped in a sealed manner between the lower face 82 of the upper part 72 of the knob 34 and the second portion 86 of the bearing surface 47 of the seal 48. When the device is in a closed position, the upper face 53 of the lateral wall 52 of the lower part 29A of the valve 29 is distant from the seal 54, the water supply pipe 15 and the water return pipe 16 both being open. With the device 1 in this open position, the plate 45 of the valve 29 is housed in the cover 44 of the puncturing device 4 and the pins 40 of the puncturing device 4 pass through the orifices 59 in the plate 45, the upper end 41 of the pins 40 then being situated in the housing 10 and having punctured the puncturable wall 42 of the capsule.

In the embodiment depicted in FIG. 13, the housing 10 comprises an upper opening through which the capsule 11 passes, said capsule 11 comprising a sealed wall 98 of which an exterior face is visible from outside the device 1.

When the knob 34 is rotated in the opposite direction corresponding to a movement for opening the device 1, the constituent elements of the device 1 collaborate in the opposite way to the way in which they collaborate in a closure movement, the knob 34 effecting a helicoidal movement that moves it away from the puncturing device 4. As a result, the return spring 88 and the incoming stream 14 push back the valve 29 so as to close the water supply pipe 15 and the water return pipe 16, the flange 12 is no longer held in a sealed manner in the housing 10 and the capsule 11 is pushed back by the plate 45 of the valve 29.

FIG. 15 depicts an alternative form of embodiment of the device in which the bearing surface is not situated on the upper face of the body. In this figure, elements identical or similar to those of FIGS. 1 to 14 bear the same reference numeral increased by 200.

In this alternative embodiment, the knob 234 rests directly on the mount 203, the inner face 278 of the knob being in direct contact with an upper face 100 of the mount 203 or in indirect contact via a sliding seal 101. The knob 234 is mounted with the ability to rotate on the mount 203 by collaboration between spikes 102 situated on the upper face of the mount 203 and complementary grooves 103 in the lower face 278 of the knob 234. A piston 104 is mounted with the capacity for translational movement in the mount 203, the bearing surface 247 intended to collaborate with the rim 273 being situated on an upper face of said piston 104. The piston 104 collaborates with the knob via spikes 235 of the piston 104 that complement a screw thread 233 belonging to the knob. The mount 203 comprises grooves 239 along the axis 25 and in which piston guide elements 265 are inserted.

When the knob 234 is turned, the screw thread 233 of the knob 234 collaborates with the spikes 235 of the piston 104 and, at the same time, the guide elements 265 of the piston 104 collaborate with the grooves 239 of the mount 203. A turning of the knob 234 therefore forces the piston 104 closer, the grooves 239 of the mount 203 limiting the movement of the piston 104 to a transverse movement. When a capsule 211 is inserted in the knob 234, the turning of the knob 234 will allow the flange 212 to be compressed between the bearing region 247 situated on the piston 104 and the interior face of the rim 273. In this embodiment, pins 240 may be situated on the piston 104 and move transversely with it to degrade the capsule 211.

Thus, in another alternative form of the device of FIG. 9, the backing ring 60 is omitted and the rim is formed only by the upper part 72 of the knob which extends over 360°, thus eliminating the opening 84. In that case, the capsule is inserted by unscrewing the knob 34 which is detached from the body in order to open the housing 10 then screwed back onto the body to bring the flange 12 into compression between the lower face 82 and the bearing surface 47.

FIGS. 18A to 18J depict exploded perspective views of the various constituent components of another embodiment of the device which is similar to that of FIG. 15. In these figures, elements identical or similar to those of FIGS. 1 to 14 bear the same reference numeral increased by 300.

FIG. 18A depicts a mount 303 according to this embodiment. In this embodiment, the mount 303 comprises a circular cylindrical internal wall 105. This wall 105 develops from an end wall 106 of the mount 303 surrounding the guide 328 of the valve 329 (see FIGS. 18D, 18E and 18F). The guide 328 is of hexagonal shape. Pins 107 are situated on the end wall 106 of the mount between the guide 328 and the wall 105. These pins 107 develop along the wall 105 over a partial height of said wall 105 in the direction of the axis 325. A peripheral upper face 109 of the mount 303 comprises a groove 108. This groove 108 develops over half a revolution of the mount 303.

FIG. 18B depicts a hollow cylindrical support 110. This support 110 complements the mount 303. This support 110 is intended to be mounted by screwing onto the screw thread 326 (see FIG. 18A) of the mount 303. The support 110 on an external lateral face 111 comprises a peripheral groove 112. The support 110 on a lower face comprises pins 113 intended to face the pins 107 of the mount 303. A first seal 114 (see FIG. 18K) is intended to be housed against the wall 105 between the pins 107 of the mount 303 and the pins 113 of the support 110 so as to surround the valve 329 in a sealed manner. The support 110 comprises a central through-passage 115. The central passage 115 comprises a radial discontinuity 116 on its lower end. The pins 113 project radially inward at the discontinuity 116 of the central passage 115. A second seal 118 (see FIG. 18K) is intended to be housed in the discontinuity 116 and to be held in position by the pins 113 so as to surround the valve 329 in a sealed manner.

FIG. 18C depicts a bolt 119 intended to be housed with the freedom to turn in the central passage 115 of the support 110. This bolt 119 is of hollow circular cylindrical shape. A lateral exterior face 120 of the bolt 119 complements the central passage 115 of the support 110 so as to allow said bolt 119 to turn in the support 110. The bolt 119 comprises a circular protuberance 121 projecting radially outward and projecting axially beyond the exterior face 120. This protuberance 121 comprises spikes 123 evenly spaced on an exterior lateral face 122. The bolt 119 has a central passage. This central passage has a screw thread 132.

FIG. 18D depicts the lower part 329A of the valve 329. FIGS. 18E and 18F depict the upper part 329B of the valve 329 from two different viewpoints.

A valve 329 is preferably made in two parts 329A and 329B bonded together for reasons of ease of manufacture but the valve could also be produced as a single piece.

In this embodiment, the guide orifice 351 of the lower face 350 of the valve 329 is of hexagonal shape complementing the guide 328. The guide 328 and the orifice 351 may have any specific shape suited to preventing the valve 329 from turning relative to the mount 303.

In this embodiment, the water supply pipe 315 and the water return pipe 316 pass through the valve 329. The outlet 319 of the water supply pipe 315 and the inlet 320 of the water return pipe 316 are situated in circular orifices 124 of an upper face 125 of the upper part 329B of the valve 329. Hollow needles 128 (see FIG. 18K) are intended to be inserted into the orifices 124 in order to perform the same role as the pins 40 in FIGS. 1 to 14. The inlet 317 of the water supply pipe 315 and the outlet 321 of the water return pipe 316 are formed jointly by the two parts 329A and 329B of the valve 329 in the form of two half-portions of the pipes at said inlet and outlet. An upper portion 126 of the lower part 329A is of a shape that complements a hollow lower portion 127 of the upper part 329B of the valve 329. When the upper part 329B of the valve is mounted on the lower part 329A of the valve 329. Upon assembling the valve 329, the portion 126 is inserted into the portion 127. The complementary nature of the portions 126 and 127 prevents one of the two parts 329A and 329B of the valve 329 from rotating with respect to the other.

An upper portion 129 of the upper part 329B of the valve 329 comprises through-orifices 130 opening onto the upper face 125 of the valve 329 on the one hand and, on the other hand, onto a lower face 150 of said upper portion 129. The upper portion 129 on an external lateral face has a screw thread 131 that complements an internal screw thread 132 (see FIG. 18C) of the bolt 119.

FIGS. 18G and 18H depict the plate 345 from two different viewpoints in this embodiment. The plate 345 on a lower face 133 comprises clips 134 that complement the through-orifices 130 of the upper portion 129 of the upper part 329A of the valve 329. A main cross section 135 of the clips 134 has dimensions in a radial plane that are smaller than the dimensions of the through-orifices 130. A length 136 of the main sections 135 is greater than the thickness of the upper portion 129 of the valve 329 through which the orifices 130 pass so as to allow said central sections 135 and the plate 345 to slide axially with respect to the valve 329. The clips 134 at an opposite end to the plate 345 have an end-stop section 137. These end-stop sections 137 project radially outward with respect to the main sections 135. When the plate 345 is being mounted on the upper part 329B of the valve 329, the clips 134 are inserted by deformation into the orifices 130 of the valve 329. Once the end-stop sections 137 have passed through the orifices 130 the clips 134 revert to their shape and the end-stop sections 137 project radially outward with respect to the through-orifices 130 of the valve 329. These end-stop sections 137 limit the axial movement of the clips 134 and therefore of the plate 345 with respect to the valve 329.

The plate 345 comprises pins 139 on a peripheral lateral wall 138. The plate 345 also comprises a discontinuity 141 on an upper peripheral edge. A circular seal 152 is housed in this discontinuity 141. This seal 152 forms the bearing surface 347 which is analogous to the bearing surface 47 described hereinabove with reference to FIGS. 1 to 14. The plate 345 also comprises, on its lower face 133, a circular housing 142 in which a third circular seal 143 is housed. The plate 345 comprises through-orifices 144 of a diameter that complements the needles 128, the needles 128 being intended to pass through these orifices 144 in the plate 345.

FIG. 18I depicts the backing ring 360 in this embodiment. The backing ring 360 is of circular cylindrical shape. The skirt 363 of this backing ring 360 comprises on an internal face 140 housings 145 of shapes that complement the pins 139 of the plate 345. The lateral wall 361 and the step 369 of the backing ring 360 have features analogous to those of the backing ring 60 described with reference to FIGS. 1 to 14 and will therefore not be described in further detail here.

FIG. 18J depicts a knob 334 according to this embodiment. In this embodiment, the spikes 35 of FIG. 7 are replaced by through-orifices 146 that complement dog points 147 (see FIG. 18K). Upon assembly, the knob 334 is positioned on the support 110 in such a way as to position the through-orifices 146 facing the groove 112 of the support 110. The dog points 147 are then mounted in the through-orifices 146 so that they project from the internal face 371 of the knob 334 into the groove 112 of the support 110. These dog points 147 block the axial movement of the knob 334, the dog points 147 collaborating with the groove 112 to limit the movement of the knob 334 to a rotational movement with respect to the support 110. The knob 334 on its lower face 378 comprises a spike 148 of a shape that complements the groove 108 of the mount 103. This spike 148 is intended to be mounted in said groove 108 during the mounting of the knob 334 on the mount 303. The internal face 371 of the knob 334 further comprises housings 151 of a shape that complements the pins 123 of the bolt 119.

FIG. 18K depicts a side view in cross section of the device of FIGS. 18A to 18L mounted in an open position.

When the device is in the open position, the inlet of the water supply pipe (these are not visible in this cross section) and the outlet 321 of the water return pipe 316 are situated facing the first seal 114. The first seal 114 closes the water supply pipe and the water return pipe 316 by providing sealing between the wall 105 of an external lateral face 117 of the lower part 329A of the valve 329. The sealing of the passage 305 is provided by the collaboration between an external lateral face 149 of the lower portion 127 of the upper part 329B of the valve 329 and the second seal 118, thus preventing water from flowing into the central passage of the bolt 119.

The spike 148 situated on the lower face 378 of the knob 334 is housed at one end of the groove 108 situated on the peripheral upper face 109 of the mount 303. The valve 329 is in the low position in the screw thread 132 of the bolt 119. The plate 345 is distant from the upper face 125 of the upper part 329B of the valve 329, the end-stop sections 137 of the clips 134 being in abutment against the lower face 150 of the upper portion 129 of the upper part 329B of the valve 329. The needles 128 are housed in the orifices 124 of the valve 329 and extend the water supply and water return pipes 316. However, the needles 128 are retracted by the plate 345 which is distant from the upper face 125, the needles 128 then not being long enough to cover the space separating the plate 345 from said upper face 125 and pass through the orifices 144 in the plate 345.

During a movement to close the device after a capsule (not depicted) has been inserted into the housing 310 formed jointly by the plate 345, the knob 334 and the backing ring 360, collaboration of the spike 148 situated on the lower face 378 of the knob 334 and of the groove 108 situated on the peripheral upper face 109 of the mount 303 limits the rotation of the knob 334 with respect to the mount 303 for example to a rotation of 180°. The groove 108 acts as an end stop halting the rotation of the knob 334 between the closed position and the open position of the device. Furthermore, the knob 334 is held axially in position with respect to the mount 303 by the guidance of the dog points 147 in the lateral groove 112 of the support 110, the dog points 147 jointly with the groove 112 blocking the axial movement of the knob 334. The knob 334 is thus limited to a rotational movement between the closed position of the device and the open position of the device and vice versa.

During the closure movement, collaboration between the pins 123 of the bolt 119 and the internal housings 151 of the knob 334 cause the bolt 119 to turn as the knob 334 is turned. This turning of the bolt 119 causes the valve 329 to effect an axial translational movement toward the knob 334 through the collaboration of the internal screw thread 132 of the bolt 119 with the external screw thread 131 of the valve 329. Rotation of the valve 329 is blocked by the collaboration between the guide 328 of the mount 303 and the guide orifice 351 of the lower part 329A of the valve 329. The backing ring 360 is itself kept fixed in terms of rotation by collaboration between the pins 139 of the plate 345 which is borne by the valve 329 and the housings 145 of the backing ring. The turning of the knob 334 and the absence of turning of the backing ring 360 allows the housing 310 to be closed in a way similar to the way described hereinabove with reference to FIGS. 1 to 14.

The axial movement of the valve 329 moves in the passage 305 the inlet of the water supply pipe and the outlet 321 of the water return pipe 316 in such a way as to position the inlet of the water supply pipe and the outlet 321 of the water return pipe 316 between the first seal 114 and the second seal 118 in axial projection, which means to say in the water flow passage 305. This positioning of the inlet of the water supply pipe and of the outlet 321 of the water return pipe 316 uncovers these pipes and allows the housing 310 to be supplied with a stream of water as explained with reference to FIGS. 1 to 14.

Furthermore, the axial movement of the valve 329 first of all causes the upper face 125 of the valve 329 to come into contact with the lower face 133 of the plate 345. As a result, the needles 128 are no longer retracted by the plate 345 and pass through the orifices 144 and project onto the upper face of the plate 345. The projection of the needles 128 allows a film of a capsule situated in the housing to be torn, as described with reference to FIGS. 1 to 14 and therefore allows the product contained in said capsule to be freed.

Next, the axial movement of the valve 329 pushes the plate 345 toward the knob 334. This movement of the plate 345 causes the bearing surface 347 and the knob 334 to move closer together and allows the flange of a capsule to be clamped between the bearing surface 347 formed by the seal 142 borne by the plate 345 and the lower faces 382 and 383 of the knob 334 and of the backing ring 360 respectively. The clamping of the flange of the capsule is performed in a way similar to that described with reference to FIGS. 1 to 14. Sealing in the housing is afforded on the one hand by the seal 143 situated on the lower face 133 of the plate 345 and, on the other hand, by the clamping of the flange of the capsule by the seal 142 that forms the bearing surface 347 and the lower faces 382 and 383 of the knob 334 and of the backing ring 360 respectively.

Thus, turning of the knob 334 from an open position of the device to a closed position allows the valve to be moved in such a way as to:

- bring the inlet of the water supply pipe and the outlet 321 of the water return pipe 316 into the passage 305 so as to uncover said pipes;
- cause the needles 128 to project from the upper face of the plate 345 so as to tear the film of the capsule;
- seal the housing 310 through contact between the third seal 143 mounted in the circular housing 142 and the upper face 125 of the valve 329;
- clamp the flange of the capsule in a sealed manner between the bearing surface 347 and the rims 382 and 383.

This then allows the product contained in the capsule to diffuse into the stream flowing through the device.

In one particular embodiment, the valve 329 is free to move axially by 5.5 mm and the plate 345 is free to move axially by 1 mm.

In a reverse movement, typically from the closed position of the device to the open position thereof, the turning of the knob causes the valve 329 and the knob 334 to move further apart. During this distancing movement, the inlet of the water supply pipe and the outlet of the water return pipe are moved toward the mount 30 in such a way that said pipes are closed off in a sealed manner by the first seal 114. First of all, while the end-stop sections 137 of the clips 134 are not in contact with the lower face 150 of the upper portion 127 of the upper part 329B of the valve 329, the movement of the valve 329 moves said valve 329 away from the plate 345. This distancing movement retracts the needles 128 into the orifices 144 of the plate 345. Next, the end-stop sections 137 collaborate with the lower face 150 in such a way as to move the plate 345 away from the knob and free the flange of the capsule in the housing. This turning of the knob 334 also causes the capsule housing 310 to open as described hereinabove with reference to FIGS. 1 to 14.

Advantageously, a visual reference is situated on the exterior face of the knob 334 to indicate the location of the spike 148. Likewise, a visual reference is situated on the external face of the mount 303. These references allow the external positions of the spike 148 in the groove 108 to be identified.

Advantageously, one of the pins 123 of the bolt 119 is of special shape and one of the housings 151 of the knob 334 is of a shape that complements said special pin 123. Such a pin 123 of special shape and the complementary housing 151 therefor guarantee that the knob 334 is mounted correctly. The same system may apply in the context of the pins 139 of the plate that complements the housings 145 of the backing ring. The needles 128 may be attached elements or incorporated directly into the upper part 329A of the valve 329. Likewise, the water supply and water return pipes passing through the valve may be formed in any suitable way, for example being situated only in the upper part 329B of the valve 329.

In the embodiments described hereinabove, the inlet of the water supply pipe and the outlet of the water return pipe are positioned along the axis of the inlet and outlet of the passage of the mount respectively. However, in alternative forms of embodiment, the orientation of the water supply pipe inlet and of the water return pipe outlet may differ. A change in orientation and in position of the inlet of the water supply pipe and/or of the outlet of the water return pipe notably allows the flow rate of the streams flowing along the water supply and water return pipes to be regulated. In addition, the inlet of the water supply pipe and the outlet of the water return pipe may open onto the external face of the valve in different radial planes but be oriented in such a way that the water supply and water return pipes are themselves situated in one and the same radial plane. Thus, in the embodiment depicted in FIG. 19, the orientation of the inlet 317 of the water supply pipe 315 and the orientation of the outlet 321 of the water return pipe 316 are such that said water supply pipe 315 and water return pipe 316 are situated in the plane of symmetry P of the mount 303.

As a general rule, the inlet of the water supply pipe is situated upstream of the passage of the mount and the outlet of the water return pipe is situated downstream of said passage. However, in certain cases, depending on the distribution of pressure in the passage, the position of the inlet of the water supply pipe and the position of the outlet of the water return pipe may be reversed. In an example depicted in FIG. 19, the outlet 321 of the water return pipe is oriented at an angle X of 30° with respect to the axis of the stream of water 153 entering the passage 305 of the mount 303 and the inlet 317 of the water supply pipe is oriented along the axis of the stream of water 154 leaving the passage 305 of the mount 303. The rate of flow of water circulating along the pipes is reduced in comparison with the scenario in which the inlet 317 of the water supply pipe is situated along the axis of the incoming stream. In addition, the circulation of the streams of water is reversed, the outlet 321 of the water return pipe being situated upstream of the passage 305 passing through the mount 303 and the inlet 317 of the water supply pipe is situated downstream of the passage 305 of the mount 303.

Although the invention has been described in conjunction with a number of particular embodiments it is quite obvious that it is not in any way restricted thereto and that it encompasses all technical equivalents of the means described and combinations thereof where these fall within the scope of the invention.

Use of the verb "comprise", "have" or "include" and conjugated forms thereof does not exclude there being other elements or steps present than those listed in a claim. The use of the indefinite article "a" or "an" with reference to an element or a step does not, unless otherwise mentioned, exclude there being a plurality of such elements or steps.

In the claims, any reference symbol between parentheses must not be interpreted as placing a restriction on the claim.

The invention claimed is:

1. A diffusion device (1) intended to accept a peripherally flanged capsule (11,12) containing a product (13) that is to be diffused into a stream of water (14), the device comprising: a body (3, 4, 110, 303) intended to be fixed to a water circuit; a bearing surface (47, 347) borne by the body directly or indirectly and forming a lower surface of a housing (10) for a peripherally flanged capsule containing a water-soluble product, a passage (16, 316) for letting the product out of the capsule housing as far as an outlet (21,321) of the passage; a knob (334, 34) mounted with the ability to rotate on the body (3, 4, 110, 303), the knob comprising an upper part (72) projecting in a direction of an axis of rotation (25, 325) of the knob beyond the bearing surface (47, 347), the knob and the bearing surface being mounted with the capacity for helicoidal rotation one with respect to the other; the knob (34, 334) being able to be brought, in a closing movement with respect to the body, from a position in which the device is open, in which position the housing (10) offers an opening (84) of a dimension greater than a diameter of the flange (12) of the capsule and intended to allow the flanged capsule to be inserted into the housing facing the bearing surface (47, 347); the closure movement of the knob being able to bring a lower face of a rim (82, 83, 382, 383) of the device to face the bearing surface (47, 347), the closure movement of the knob comprising a rotational movement of the knob with respect to the body causing a helicoidal movement between the knob and the bearing surface capable of bringing a lower face of the rim (82, 83, 382, 383) and the bearing surface (47, 347) closer together in order by compression to hold a peripheral portion of the flange of the capsule between the rim and the bearing surface in a sealed manner when the device is in a closed position.

2. The device as claimed in claim 1, in which the bearing surface (47) is situated on an upper face (38) of the body (4), the knob (34) being mounted with the capacity for helicoidal rotation on the body.

3. The device as claimed in claim 1, in which the lower face of the rim (82, 83) develops over 360° about an axis (25) of rotation of the knob, the bearing surface (47) develops over 360° about the axis (25) of rotation of the knob, the closure movement of the knob being able to bring the lower face of the rim to face the bearing surface over 360° so as to allow the flange of the capsule to be inserted in a sealed manner between said rim and the bearing surface over 360° when the device is in the closed position.

4. The device as claimed in claim 1, in which the rim delimits with the bearing surface a peripheral groove (81) of the housing (10) which the peripheral groove is open toward the inside of the housing and intended to accept the flange of the capsule, the opening of the housing when the device is in an open position being delimited by a portion of the bearing surface that does not face the lower face of the rim.

5. The device as claimed in claim 1, in which a backing ring (60) is mounted such that it is translationally mobile in the body (4), said backing ring comprising a shoulder (70) projecting in an axial direction of the body beyond the bearing surface, the rim of the device comprising a lower face (83) of the shoulder, the backing ring (60) being coupled to the knob (34) so as to be driven by the knob in the closure movement so as to bring the lower face (83) of the shoulder (70) of the backing ring and the bearing surface closer together in order by compression to keep a portion of the flange of the capsule between the bearing surface (47) and the lower face of the shoulder in a sealed manner.

6. The device as claimed in claim 5, in which the backing ring (60) comprises a skirt (63) of a shape that complements a trench (37) in the body, the skirt of the backing ring being inserted into the trench, a face (64) of the skirt having axially extending ribs (65), the trench comprising axially extending grooves (39) that complement the ribs of the skirt so as to guide the movement of the backing ring with respect to the body in an axial movement.

7. The device as claimed in claim 5, in which the rim of the device comprises a lower face (82) of the upper part (72) of the knob (34), the lower face (82) of the upper part of the knob constituting a first portion of the rim of the device, the lower face (83) of the shoulder (70) of the backing ring (60) constituting a second portion of the rim of the device, the closure movement of the knob being able to bring the first portion of the rim (82) to face a second portion (86) of the bearing surface (47) while at the same time bringing said first portion of the rim and said second portion of the bearing surface closer together and being able to bring the second portion of the rim (83) to face a first portion (85) of the bearing surface while at the same time bringing said second portion of the rim and the first portion of the bearing surface closer together so as to trap the flange of a capsule between, on the one hand, the first portion (85) of the bearing surface and the second portion (83) of the rim and, on the other hand, the second portion (86) of the bearing surface and the first portion (82) of the rim.

8. The device as claimed in claim 7, in which the first portion of the rim and the second portion of the rim are in distinct planes.

9. The device as claimed in claim 7, in which the first portion of the rim has the shape of an arc of a circle with a first radius and the second portion of the rim has the shape of an arc of a circle with a second radius greater than the first radius and concentric with the first portion of the rim, when the device is in the open position, the shoulder of the backing ring being housed at least partially in a groove in the upper part of the knob.

10. The device as claimed in claim 7, in which the first portion of the rim faces the bearing surface over half or more of the periphery of the bearing surface and the second portion of the rim faces the bearing surface over half or more of the periphery of the bearing surface.

11. The device as claimed in claim 1, comprising a water supply passage (15) supplying water from a water inlet (17) as far as the capsule housing.

12. The device as claimed in claim 11, in which the outlet passage and/or the water supplying passage pass through the body as far as the lower surface of the housing.

13. The device as claimed in claim 11, comprising a water supply control element (29A) able to close off or uncover the water supplying passage (15) and/or the outlet passage (16), the control element being able to move in the device from a closed position in which the water return control element closes off the water supplying passage and/or the outlet passage as far as an open position in which the water supplying passage and/or the outlet passage is uncovered, the device comprising a return element (88) applying a return force to the control element, said return force being able to keep the control element in the closed position when there is no opposing force applied to said control element, the device comprising a plate (45) placed on an upper face (38) of the body in the central region of the housing which the central region is surrounded by the bearing surface (47) and able to move in the axial direction (25), the plate (45) being coupled to the control element (29A) and being able to apply a thrust force to the control element, said thrust force causing the control element to move into the open position.

14. The device as claimed in claim 1, comprising a puncturing mechanism intended to degrade a wall (42) of a capsule inserted into the housing so as to create a communication between the inside of the capsule containing the product and the outside of the capsule and in which the puncturing mechanism comprises two puncturing pins (40) borne by the body in such a way as to project in the axial direction (25) in a central region of the housing which region is surrounded by the bearing surface, the device comprising a plate (45) arranged in the central region of the housing which the central region is surrounded by the bearing surface and able to move in the axial direction between a deployed position in which the plate masks the pins (40) and a retracted position in which the plate uncovers the puncturing pins (40).

15. The device as claimed in claim 14, in which the outlet passage (16) comprises an inlet (20) situated on an upper face (43B) of one of the pins (40B) of the puncturing mechanism.

16. The device as claimed in claim 13, in which the body comprises on its upper face a cover (44) of a shape that complements the plate, the pins being situated on the upper face of the body in the cover, a movement of the plate from its deployed position into its retracted position causing the water return control element (29A) to move into the open position.

17. The device as claimed in claim 1, the device further comprising a valve (29, 329) comprising the bearing surface and mounted with the capacity for axial translational movement in the body (3, 4, 110, 303), the valve having the capacity for helicoidal rotational movement with respect to the knob.

18. The device as claimed in claim 17, in which the body comprises a shoulder (70) projecting in the axial direction of the body beyond the bearing surface, the rim of the device comprising a lower face (83, 383) of the shoulder, the valve being coupled to the knob (34) to be driven in axial translation by the knob during the closure movement so as to bring the bearing surface and the lower face (83, 383) of the shoulder (70) closer together so as by compression to hold a portion of the flange of the capsule between the bearing surface (47, 347) and the lower face of the shoulder in a sealed manner.

19. The device as claimed in claim 17, in which the rim of the device comprises a lower face (82, 382) of the upper part (72) of the knob (34, 334), the lower face (82, 382) of the upper part of the knob constituting a first portion of the rim of the device, the lower face (83, 383) of the shoulder (70) constituting a second portion of the rim of the device, the closure movement of the knob being able to bring the first portion of the rim (82, 382) to face a second portion (86) of the bearing surface (47, 347) while at the same time bringing said second portion of the bearing surface and said first portion of the rim closer together and being able to bring the second portion of the rim (83, 383) to face a first portion (85) of the bearing surface while at the same time bringing the first portion of the bearing surface and said second portion of the rim closer together so as to trap the flange of a capsule between, on the one hand, the first portion (85) of the bearing surface and the second portion (83, 383) of the rim and, on the other hand, the second portion (86) of the bearing surface and the first portion (82, 382) of the rim.

20. The device as claimed in claim 19, in which the first portion of the rim faces the bearing surface over half or more of the periphery of the bearing surface and the second portion of the rim faces the bearing surface over half or more of the periphery of the bearing surface.

21. The device as claimed in claim 17, comprising a water supply passage (15) supplying water from a water inlet (17) as far as the capsule housing, and in which the outlet passage and the water supplying passage pass through the valve as far as the lower surface of the housing.

22. The device as claimed in claim 21, in which the valve comprises a water supply control element (29A, 329A) surrounded in a sealed manner by a first seal borne by the body and by a second seal borne by the body, the first and second seals being spaced apart from one another in the axial direction of translational movement of the valve, the valve being able to move in the body, from a closed position in which the water inlet of the second passage and the outlet of the first passage are situated axially in line with the first seal so as to be closed off by the first seal as far as an open position in which the water inlet and the water outlet of the passage are situated in axial projection between the two seals and the water inlet and water outlet of the passage are uncovered.

23. The device as claimed in claim 17, comprising a puncturing mechanism intended to degrade a wall (42) of a capsule inserted into the housing so as to create a communication between the inside of the capsule containing the product and the outside of the capsule and in which the puncturing mechanism comprises two pins (40, 128) which are situated on an upper face of the valve so as to project in the axial direction (25, 325) in a central region of the housing which region is surrounded by the bearing surface when the knob is in the closed position, the device comprising a plate (45, 345) bearing the bearing surface and able to move in the axial direction with respect to the valve between a deployed position in which the plate masks the pins (40, 128) and a retracted position in which the plate uncovers the puncturing pins (40, 128).

24. The device as claimed in claim 1, in which the body comprises a hollow mount (3, 203, 303) comprising an inlet (6), an outlet (7) and a passage (5) for the stream of water between the inlet and the outlet of the mount, the outlet of the outlet passage being situated in a downstream part of the water passage of the mount and oriented toward the outlet of the mount so as to create a reduced pressure at the outlet of the outlet passage.

25. The device as claimed in claim 1, in which the housing comprises an opening (74) at the center of the knob intended to allow a sealed body (98) of the capsule to protrude beyond an upper face of the device.

* * * * *